US005310641A

United States Patent [19]

Matsuzaka et al.

[11] Patent Number: 5,310,641

[45] Date of Patent: * May 10, 1994

[54] NEGATIVE TYPE SILVER HALIDE PHOTOGRAPHIC MATERIAL COMPRISING SILVER HALIDE GRAINS OF CORE-SHELL STRUCTURE

[75] Inventors: Syoji Matsuzaka, Hachioji; Shu Nishiwaki; Yoshihiko Suda, both of Hino; Takashi Kamio, Hachioji; Toshimi Terai, Kodaira; Toshimi Iijima, Kokubunji, all of Japan

[73] Assignee: Konica Corporation, Tokyo, Japan

[ * ] Notice: The portion of the term of this patent subsequent to Sep. 8, 2004 has been disclaimed.

[21] Appl. No.: 780,848

[22] Filed: Oct. 23, 1991

Related U.S. Application Data

[63] Continuation of Ser. No. 566,867, Aug. 13, 1990, abandoned, which is a continuation of Ser. No. 364,533, Jun. 12, 1989, abandoned, which is a continuation of Ser. No. 140,947, Dec. 28, 1987, abandoned, which is a continuation of Ser. No. 854,582, Apr. 22, 1986, abandoned.

[30] Foreign Application Priority Data

Apr. 23, 1985 [JP] Japan ..... 60-86659

[51] Int. Cl.[5] ..... G03C 1/035

[52] U.S. Cl. ..... 430/567; 430/569

[58] Field of Search ..... 430/567, 569,

[56] References Cited

U.S. PATENT DOCUMENTS

| | | | |
|---|---|---|---|
| 4,444,877 | 4/1984 | Koitabashi et al. | 430/567 |
| 4,477,564 | 10/1984 | Cellone et al. | 430/567 |
| 4,507,386 | 3/1985 | Matsuzaka et al. | 430/567 |
| 4,565,778 | 1/1986 | Migamoto et al. | 430/567 |
| 4,614,711 | 9/1986 | Sugimoto et al. | 430/567 |
| 4,668,614 | 5/1987 | Takada et al. | 430/567 |
| 4,692,400 | 9/1987 | Kumashiro et al. | 430/553 |
| 4,990,437 | 2/1991 | Iijima et al. | 430/558 |

FOREIGN PATENT DOCUMENTS

| | | | |
|---|---|---|---|
| 147854 | 7/1985 | European Pat. Off. . | |
| 147868 | 7/1985 | European Pat. Off. | 430/567 |
| 3310609 | 10/1983 | Fed. Rep. of Germany . | |
| 60-35726 | 2/1985 | Japan . | |

*Primary Examiner*—Janet C. Baxter

*Attorney, Agent, or Firm*—Finnegan, Henderson, Farabow, Garrett & Dunner

[57] ABSTRACT

A negative type silver halide photographic material having silver halide grains of a core-shell structure. An inner core essentially consists of silver bromide or silver iodobromide and a plurality of shells consists essentially of silver bromide or silver iodobromide. The shells of each silver halide grain have (1) an outermost shell containing silver iodide of 0 to 10 mol %, (2) a highly iodide-containing shell provided inside the outermost shell and having a silver iodide content at least 6 mol % higher than that of the outermost shell, and (3) an intermediate shell provided between the outermost shell and the high iodide-containing shell. The silver iodide content of the intermediate shell is 3 mol % higher than that of the outermost shell and at least 3 mol % lower than that of the high iodide-containing shell.

22 Claims, No Drawings

NEGATIVE TYPE SILVER HALIDE PHOTOGRAPHIC MATERIAL COMPRISING SILVER HALIDE GRAINS OF CORE-SHELL STRUCTURE

This application is a continuation of application Ser. No. 07/566,867 filed Aug. 13, 1990, now abandoned, which is a continuation application of Ser. No. 07/364,533 filed Jun. 12, 1989, now abandoned, which is a continuation application of Ser. No. 07/140,947 filed Dec. 28, 1987, now abandoned, which is a continuation application of Ser. No. 06/854,582, filed Apr. 22, 1986, now abandoned.

BACKGROUND OF THE INVENTION

This invention relates to a silver halide photographic light-sensitive material containing negative type silver halide grains each having an inner core substantially comprising silver bromide or silver iodobromide and a plurality of outer shells each provided to the outside of the inner core and substantially composed of silver bromide or silver iodobromide.

In recent years, as there have been more strict requirements for silver halide emulsions for photographic use, so have increased the demands for the high-level photographic characteristics such as a high-speed, an excellent graininess, a high sharpness, a low fog-density, a sufficiently wide exposure range and so on.

There have been the well-known high-speed emulsions such as a silver iodobromide emulsion containing silver iodide in an amount of from 0 to 10 mol % of the emulsion, to satisfy the above-mentioned requirements. About the methods of preparing the above-mentioned emulsions, there have so far been the well-known methods including, for example, an ammonia method, a neutral method, such a method as an acid method in which the conditions of pH and pAg values are controlled, and such a precipitation method as a single-jet or double-jet method.

Based upon the above-mentioned prior art and with the purposes of making the sensitivity of light-sensitive materials higher and improving the graininess thereof and, further, achieving both of the high sharpness and low fog thereof, the technical means have so far been researched with an utmost precision and have then been put into practice. A silver iodobromide emulsion which is an object of the invention have been studied so as to control not only the crystal habits and grain distribution but also the iodide content distribution in an individual silver halide grain.

For realizing the photographic characteristics including, for example, a high speed, excellent graininess, high sharpness or low fog density, the most orthodox process therefor is to improve the quantum efficiency of a silver halide used. For realizing this purpose, the observation of solid state physics and the like have positively been adopted.

There are the researches in which the above-mentioned quantum efficiency was theoretically computed and the influence on a graininess distribution was also studied. One of the researches is described in, for example, the preprints of 1980 Tokyo Symposium on Photographic Progress, titled 'Interactions Between Light and Materials', p. 91. This research predicts that a quantum efficiency could effectively be improved if a monodispersed emulsion may be prepared by narrowing a grain distribution. Further, in the so-called chemical sensitization process for sensitizing a silver halide emulsion (This process will be described in detail later.), it may be reasonably presumed that a monodispersed emulsion may also be advantageous to effectively make a light-sensitive material highly sensitive with keeping a low fog level.

For industrially preparing such a monodispersed emulsion, it is desired, as described in Japanese Patent Publication Open to Public Inspection (hereinafter called Japanese Patent O.P.I. Publication) No. 4821/1979, to apply both of the theoretically predetermined conditions of the feeding rate controls of silver ions and halide ions to be fed into a reaction system and the satisfactory conditions of the agitation thereof to the preparation process under the strict controls of the pAg and pH values of the emulsion. When a silver halide emulsion is prepared under the above-mentioned conditions, it is in either one of the cubic, octahedral and tetradecahedral crystal forms. That is to say, such an emulsion comprises the so-called normal crystal grains each having both of the (100) and (111) planes in various ratios. It is well-known that a high sensitization may be achieved by making use of the above-mentioned normal crystal grains.

Meanwhile, it has so far been well-known that the silver halide emulsions suitably used in high speed photographic films include a silver iodobromide emulsion comprising polydispersed type twinned crystal grains.

Also, silver iodobromide emulsions each containing tabular shaped twinned crystal grains are disclosed in, for example, Japanese Patent O.P.I. Publication No. 113927/1983 and others.

On the other hand, Japanese Patent O.P.I. Publication No. 22408/1978; Japanese Patent Examined Publication No. 13162/1968; 'Journal of Photographic Science', No. 24, p. 198, 1976; and the like each describe, respectively, that a development activity is increased or a high sensitization is realized by making use of multilayered type silver halide grains applied with a plurality of shells on the outside of the inner cores of the grains.

Further, West German Patent No. 2,932,650; Japanese Patent O.P.I. Publication Nos. 2417/1976, 17436/1976 and 11927/1977; and the like describe the respective silver halide grains each provided with a covering layer through a halogen substitution so as to serve as the outermost layer of the silver halide grain. These silver halide grains are practically unable to serve as any negative type emulsion, because a fixing time may be shortened thereby, however, to the contrary, a development may be thereby inhibited, so that a satisfactory sensitivity may not be obtained.

There is also well-known positive type (i.e., an internal latent image type) silver halide grains each provided outside the inner core thereof with a plurality of covering layers prepared through a halogen substitution, of which are described in, for example, U.S. Pat. Nos. 2,592,250 and 4,075,020; and Japanese Patent O.P.I. Publication No. 127549/1980. These silver halide grains are often used in an internal latent image type direct positive light-sensitive material such as those for diffusion transferring use. However, they cannot be used at all in any negative type emulsion to which the invention directed, because the internal sensitivity thereof is excessively high from the very nature of things.

There is a further silver halide grain provided on the inner core thereof with shells, as described above, and in which various iodide contents of the respective layers thereof are taken into account. This type of grains are described in, for example, Japanese Patent O.P.I. Publication Nos. 181037/1983, 35726/1985 and 116647/1984.

In the field of silver halide photographic light-sensitive materials, color light-sensitive materials each having an ISO speed of 1000 or over have recently been introduced, thanks to the various technical progress. It is, however, usual that such a light-sensitive material is deteriorated in graininess and sharpness as it becomes higher in sensitivity, and such a high speed light-sensitive material is yet very unsatisfactory for the consumers who want to admire a good photograph because its image quality is not good enough as compared with those of a conventional light-sensitive material. Therefore, a high-speed negative type light-sensitive material excellent in graininess and image sharpness has so far been demanded.

For astronomical photography, indoor photography, sport photography and the like, a further high-speed negative type light-sensitive material has particularly been demanded.

SUMMARY OF THE INVENTION

It is an object of the invention to provide a negative type silver halide photographic light-sensitive material which is high in sensitivity, excellent in the correlation between the sensitivity and a fog, wide in the exposure range, and excellent in both graininess and image sharpness.

The above-mentioned object can be accomplished by a negative type silver halide photographic material comprising silver halide grains of a core-shell structure which consists of an inner core essentially consisting of silver bromide or silver iodobromide and a plurality of shells, essentially consisting of silver bromide or silver iodobromide, wherein each of the silver halide grains comprises an outermost shell containing silver iodide of 0 to 10 mol %, a highly iodide-containing shell provided inside the outermost shell, of which silver iodide content is at least 6 mol % higher than that of the outermost shell, and an intermediate shell provided therebetween the silver iodide content of the intermediate shell being at least 3 mol % higher than that of the outermost shell, and at least 3 mol % lower that of the high iodide-containing shell.

DETAILED DESCRIPTION OF THE INVENTION

In the silver halide composition of the silver halide grains relating to the invention. the expression, 'substantially comprising—', means that the above-mentioned silver halide grains are allowed to contain such a silver halide other than silver bromide or silver iodide as silver chloride and, more particularly, means that the content thereof is desirably not more than 1 mol % if it is silver chloride, provided that the content thereof does not disturb the advantages of the invention.

The special features of the photographic light-sensitive materials of the invention may be summarized as given below:

(1) A high-speed, a wide exposure range and an excellent graininess (as compared with non-core/shell type emulsions) may be obtained by making use of emulsion containing core/shell type silver halide grains each provided to the inside thereof with highly iodide-containing shells;

(2) A further high-speed may be obtained by interposing an intermediate shell between the highly iodide-containing shell and the outermost low iodide-containing shell, provided that the iodide content of the intermediate shell is in an amount between that of the low iodide-containing shell and that of the outermost shell;

(3) A preferable iodide content of the highly iodide-containing shell is from 6 to 40 mol % and is made not less than 6 mol % higher than the outermost shell. If the iodide content thereof is less than 6 mol % (or, if it is less than 6 mol % only higher than that of the outermost shell), the sensitivity of a light-sensitive material is lowered. To the contrary, if it exceeds 40 mol %, the light-sensitive material is polydispersed. It is, therefore, preferred from the viewpoint of the sensitivity and the image sharpness that the iodide content of a highly iodide-containing shell may not exceed 40 mol %.

(4) The difference between the iodide content of an intermediate shell and that of the outermost shell or that of a highly iodide-containing shell shall not be less than 3 mol %, respectively. Because, if the difference is too little, the advantages of the intermediate shell are reduced. (i.e., the sensitivity of a light-sensitive material is lowered.) From the viewpoint of that the advantages of the intermediate shell (in sensitivity, monodispersibility, fog-sensitivity correlation and image sharpness) are effectively induced, it is preferred to specify the upper limit of the difference between these iodide contents up to 35 mol %.

(5) When the iodide content of the whole silver halide grains is in excess, the developability and sensitivity of a light-sensitive material tend to be lowered, while it is in short, the gradation tends to be too hard and the exposure range narrowed and further the graininess worsened. It is, therefore, preferred to choose a suitably specified range of iodide contents.

(6) A monodispersed emulsion is superior to a polydispersed emulsion in sensitivity, sharpness and the correlation between fogginess and sensitivity. That is to say, in such polydispersed emulsions, an ideal core/shell structure may hardly be formed, because the shell-forming reactions thereof are not uniform; and fine grains are present therein so as to deteriorate the sharpness; and, further, the sensitivity thereof is lowered and the correlation between fogginess and sensitivity tends to be worsened, because the optimum conditions for chemically sensitizing the emulsion after the grains thereof were formed depend upon the individual grains. Therefore, the monodispersed emulsions are preferably used instead.

(7) When a light-sensitive material is multilayered, the multilayer-sensitivity thereof will be inferior to a monolayer-sensitivity. (This phenomenon is called an interlayer desensitization effect.) The emulsions of the invention is not only high in sensitivity of the monolayer thereof but also hardly be affected by the above-mentioned interlayer desensitization effect. Therefore, the emulsions of the invention may effectively be used in such multilayered color light-sensitive materials.

For the purpose of further improving the above-mentioned excellent effects in the following terms;

Ih: An iodide content of a highly iodide-containing shell (mol %);

Im: An iodide content of an intermediate shell (mol %); and

Il: An iodide content of an outermost shell (mol %); it is preferred to provide $\Delta I = Ih - Il > 8$ mol %, $\Delta Ih = Ih - Im > 4$ mol % and $\Delta Il = Im - Il > 4$ mol %; and it is further preferred to provide $\Delta I > 10$ mol %, $\Delta Ih > 4$ mol % and $\Delta Il > 4$ mol %. {Refer to the above-mentioned Item (4)); wherein Il is preferably from 0 to 5 mol %, more preferably 0 to 3 mol % and even, more preferably, from 0 to 2 mol % and, further preferably, from 0 to 1 mol %; and Ih is preferably from 6 to 40 mol % and, more preferably, from 10 to 40 mol %. (Refer to the above-mentioned Item (3)).

Further, the volume of an outermost shell is preferably from 4 to 70% of a whole grain and, more preferably, from 10 to 50% thereof. The volume of a highly iodide-containing shell is preferably from 10 to 80% of a whole grain and, more preferably, from 20 to 50% and, further preferably, from 20 to 45% thereof. The volume of an intermediate shell is preferably from 5 to 60% of a whole grain and, more preferably, from 20 to 55% thereof. Such highly iodide-containing shell is allowed to be at least one part of an inner core and, more preferably, a separate inner shell is made present inside the highly iodide-containing shell.

The iodide content of such an inner shell or inner core is preferably from 0 to 40 mol % and, more preferably, from 0 to 10 mol % and, further preferably, from 0 to 6 mol %. The grain size of such an inner core is preferably from 0.05 to 0.8 μm and, more preferably, from 0.05 to 0.4 μm.

In the distinctive features described in the above-mentioned Item (5), the iodide content of a whole grain is preferably from 1 to 20 mol % and, more preferably, from 1 to 15 mol % and, further preferably, from 2 to 12 mol %. In the distinctive features described in the above-mentioned Item (6), the grain size distribution is allowed to be either one of the polydisperse type and the monodispere type. However, variation coefficient of such grain size distribution is preferably not more than 20% in a monodispersed emulsion and, more preferably, not more than 15%. Such a variation coefficient will be defined as follows to measure a monodispersibility:

$$\text{Variation coefficient (\%)} = \frac{\text{Standard deviation of grain size}}{\text{Average grain size}} \times 100$$

As for a multilayered color light-sensitive material having the features mentioned in the Item (7), it is desired that a multilayered arrangement is made of not less than three emulsion layers comprising three kinds of light-sensitive layers; a blue-sensitive layer, a red-sensitive layer and a green-sensitive layer; and at least one emulsion layer thereof contains the silver halide grains relating to the invention or the above-mentioned desirable silver halide grains.

A grain size of a silver halide grain (which is defined as a length of one side of a cube having the same volume as that of the silver halide grain) is preferably from 0.1 to 3.0 μm; and the configuration thereof may be any one of an octahedron. a cube, a sphere, a flat plate and the like and, more preferably, an octahedron.

The layer arrangements of the silver halide grains of the invention will further be described below:

As mentioned above, an inner shell and a highly iodide-containing shell may be the same, or the such inner shell may separately be provided to the inside of the highly iodide-containing shell. An inner shell and a highly iodide-containing shell, the highly iodide-containing shell and an intermediate shell, and the intermediate shell and the outermost shell are allowed to be adjacent to each other; and, in addition, it is also allowed that another shell comprising at least one layer having an arbitrary composition (hereinafter called an arbitrary shell) may be interposed between the above-mentioned shells.

The above mentioned arbitrary shell may be any one of a monolayered shell having a uniform composition, a group of the shells which comprises a plurality of shells each having a uniform composition and changes its composition stepwise, a continuous shell which changes its composition continuously in its arbitrary shell, and the combination thereof. The above-mentioned highly iodide-containing shell and intermediate shell may be used plurally or in only a pair.

Next, the examples of the layer arrangements of the silver halide grains relating to the invention will now be described:

Wherein, an iodide content will be represented by I. Subscripts denote the order of shells.

1. 3-layer structure of an inner core = a highly iodide-containing shell:

| | iodide content | Shell diameter |
|---|---|---|
| Core (3rd) (Inner core = Highly iodide-containing shell) | | |
| $I_3 - I_2 > 3$ mol % | $I_3 = 15$ mol % | 1.2 μm |
| 2nd shell (Intermediate shell) | | |
| $I_2 - I_1 > 3$ mol % | $I_2 = 5$ mol % | 1.4 μm |
| 1st shell (Outermost shell) | | |
| $I_1 = 0 \sim 10$ mol % | $I_1 = 0.5$ mol % | 1.6 μm |

2. 6-layer structure interposing the 4th and 5th shells each having an arbitrary composition between an inner core and a highly iodide-containing shell:

| | iodide content | Shell diameter |
|---|---|---|
| Core (6th) (Inner core) | | |
| Arbitrariness | $I_6 = 4.0$ mol % | 0.1 μm |
| 5th shell (Arbitrary shell) | | |
| Arbitrariness | $I_5 = 2.0$ mol % | 0.27 μm |
| 4th shell (Arbitrary shell) | | |
| Arbitrariness | $I_4 = 2.6$ mol % | 0.8 μm |
| 3rd shell (Highly iodide-containing shell) | | |
| $I_3 - I_2 > 3$ mol % | $I_3 = 15.0$ mol % | 1.12 μm |
| 2nd shell (Intermediate shell) | | |
| $I_2 - I_1 > 3$ mol % | $I_2 = 5.0$ mol % | 1.44 μm |
| 1st shell (Outermost shell) | | |
| $I_1 = 0 \sim 10$ mol % | $I_1 = 0.5$ mol % | 1.6 μm |

3. 7-layer structure interposing the 5th and 6th shells between an inner shell and a highly iodide-containing shell and also interposing a 2-layered intermediate shell between the outermost shell and the highly iodide-containing shell:

| | iodide content | Shell diameter |
|---|---|---|
| 7th shell (Inner core) | | |
| | $I_7 = 4$ mol % | 0.10 μm |
| 6th shell (Arbitrary shell) | | |
| Arbitrariness | $I_6 = 2$ mol % | 0.27 μm |
| 5th shell (Arbitrary shell) | | |
| Arbitrariness | $I_5 = 8$ mol % | 0.8 μm |
| 4th shell (Highly iodide-containing shell) | | |
| $I_4 = I_3 > 3$ mol % | $I_4 = 15$ mol % | 1.12 μm |

-continued

| | iodide content | Shell diameter |
|---|---|---|
| 3rd shell (Intermediate shell) | | |
| $I_3 - I_1 > 3$ mol % | $I_3 = 8$ mol % | 1.24 μm |
| $I_4 - I_3 > 3$ mol | | |
| 2nd shell (Intermediate shell) | | |
| $I_2 - I_1 > 3$ mol % | $I_2 = 4$ mol % | 1.44 μm |
| $I_4 - I_2 > 3$ mol % | | |
| 1st shell (Outermost shell) | | |
| $I_1 = 0 \sim 10$ mol % | $I_1 = 0.5$ mol % | 1.6 μm |

4. 8-layer structure interposing respectively the arbitrary 6th and 7th shells between an inner shell and a highly iodide-containing shell, an arbitrary single-layered shell (4th shell) between a highly iodide-containing shell (5th shell) and an intermediate shell (3rd shell), and an arbitrary single-layered shell (2nd shell) between the intermediate shell (3rd shell) and the outermost shell:

| | iodide content | Shell diameter |
|---|---|---|
| 8th shell (Inner core) | | |
| Arbitrariness | $I_8 = 4$ mol % | 0.10 μm |
| 7th shell (Arbitrary shell) | | |
| Arbitrariness | $I_7 = 2$ mol % | 0.27 μm |
| 6th shell (Arbitrary shell) | | |
| Arbitrariness | $I_6 = 4$ mol % | 0.8 μm |
| 5th shell (Highly iodide-containing shell) | | |
| $I_5 - I_3 > 3$ mol % | $I_5 = 15$ mol % | 1.12 μm |
| 4th shell (Arbitrary shell) | | |
| Arbitrariness | $I_4 = 9$ mol % | 1.24 μm |
| 3rd shell (Intermediate shell) | | |
| $I_3 - I_1 > 3$ mol % | $I_3 = 5$ mol % | 1.44 μm |
| 2nd shell (Arbitrary shell) | | |
| Arbitrariness | $I_2 = 4.5$ mol % | 1.50 μm |
| 1st shell (Outermost shell) | | |
| $I_1 = 0 \sim 10$ mol % | $I_1 = 2$ mol % | 1.6 μm |

5. Structure having a plurality of highly iodide-containing shells:

| | iodide content | Shell diameter |
|---|---|---|
| 6th shell (Inner core) | | |
| Arbitrariness | $I_6 = 4$ mol % | 0.10 μm |
| 5th shell (Highly iodide-containing shell) | | |
| $I_5 - I_2 > 3$ mol % | $I_5 = 15$ mol % | 0.27 μm |
| $I_5 - I_1 > 6$ mol % | | |
| 4th shell (Arbitrary shell) | | |
| Arbitrariness | $I_4 = 5$ mol % | 0.80 μm |
| 3rd shell (Highly iodide-containing shell) | | |
| $I_3 - I_2 > 3$ mol % | $I_3 = 15$ mol % | 1.12 μm |
| $I_3 - I_1 > 6$ mol % | | |
| 2nd shell (Intermediate shell) | | |
| $I_1 - I_2 > 3$ mol % | $I_2 = 5$ mol % | 1.44 μm |
| 1st shell (Outermost shell) | | |
| $I_1 = 0 \sim 10$ mol % | $I_1 = 0.3$ mol % | 1.60 μm |

The inner cores of the silver halide grains of the invention can be prepared in such a process as described in, for example, P. Glafkides, 'Chimie et Physique Photographique', published by Paul Montel, 1967; G. F. Duffin, 'Photographic Emulsion Chemistry', published by The Focal press, 1966; V. L. Zelikman et al., 'Making and Coating Photographic Emulsion', published by The Focal Press, 1964; and the like. Such processes include any one of an acid method process, a neutral method process, an ammonia method process and the like. Further, a single-jet precipitation process, a double-jet precipitation process or the combination thereof may also be applied to make a reaction of a soluble silver salt on a soluble halide.

Still further, it is also allowed to use the so-called reverse precipitation process in which grains may be formed in presence of silver ions in excess. The so-called controlled double-jet precipitation process, a version of the double-jet precipitation processes, may also be applied for keeping a pAg value of a silver halide produced in a liquid phase. According to this process, a silver halide emulsion regular in crystal form and nearly uniform in grain size may be prepared.

It is also allowed to use a mixture of not less than two kinds of silver halide emulsions each prepared separately, and in this case a double-jet precipitation process or a controlled double-jet precipitation process is preferably used.

A pAg value is varied in accordance with a reaction temperature and the kinds of silver halide solvents when an inner core is prepared, and is preferably from 2 to 11. It is also preferred to use a silver halide solvent, because a grain-forming time may be shortened. Such a silver halide solvent as those of ammonia or thioether which is well-known may be used.

Inner cores may be used in a flat plate, sphere or twinned crystal system and also in the form of an octahedron, cube, tetradecahedron or the mixed forms thereof.

In order to uniform grain sizes, it is preferred to grow up grains rapidly within the critical saturation limit, in such a process as described in, for example, British Patent No. 1,535,016; and Japanese Patent Examined Publication Nos. 36890/1973 and 16364/1977, in which the respective adding rates of silver nitrate and an aqueous solution of a halogenated alkali are adjusted according to the growth rate of grains; or in such a process as described in, for example, 4,242,445 and Japanese Patent O.P.I. Publication No. 158124/1980, in which the concentration of an aqueous solution is adjusted. The above-mentioned processes are advantageously used also in the case of introducing arbitrary shells, highly iodide-containing shells, intermediate shells or the outermost shells, because any new renucleation will not occur and each silver halide grain is uniformly coated in these processes.

In the invention, if occasion demands, a single shell or a plurality of arbitrary shells may be interposed between a highly iodide-containing shell comprising silver halide grains and an intermediate shell. Such highly iodide-containing shells may be provided in such a process as that a desalting step is applied, if necessary, to the resulted inner shell or the inner shell provided with an arbitrary shell and an ordinary halogen substitution process, a silver halide coating process or the like is then applied.

The halogen substitution process may be applied in the manner, for example, that, after an inner core is formed, an aqueous solution mainly comprising an iodide compound (preferably, potassium iodide), which is preferably not higher than 10% in concentration, is added. This processes are more particularly described in, for example, U.S. Pat. Nos. 2,592,250 and 4,075,020; Japanese Patent O.P.I. Publication No. 127549/1980; and the like. For decreasing an iodide distribution difference between the grains of the highly iodide-containing shell, it is desired, in this process, to adjust the concentration of an aqueous iodide compound solution to $10^{-2}$ mol % or lower and then to add the solution by taking a time for not shorter than ten minutes.

The processes of newly coating a silver halide over to an inner core include, for example, the so-called double-jet precipitation process and controlled double-jet precipitation process each in which an aqueous halide solution and an aqueous silver nitrate solution are simultaneously added. To be more concrete, the processes are described in detail in, for example, Japanese Patent O.P.I. Publication Nos. 22408/1978 and 14829/1983; Japanese Patent Examined Publication No. 13162/1968; 'Journal of Photographic Science', No. 24,198, 1976; and the like.

When a highly iodide-containing shell is formed, a pAg value is varied in accordance with a reaction temperature and the kinds and the amount of silver halide solvents used. The same conditions as those for the case of the above-mentioned inner core are preferably applied to this case. When using ammonia to serve as a solvent, a pAg value is desirably from 7 to 11.

Among the processes of forming a highly iodide-containing shell, a double-jet precipitation process and a controlled double-jet precipitation process are preferred more than others.

The intermediate shells of the silver halide grains of the invention may be provided in such a manner that a highly iodide-containing shell is arranged onto the surface of a grain containing the above-mentioned highly iodide-containing shells and the inner shells, or, if required, the highly iodide-containing shell is provided thereon with a single or plurality of arbitrary shells and, to the outside of the above-mentioned grain, a silver halide having a halogen composition different from those of the highly iodide-containing shells is further coated in a double-jet or controlled double-jet precipitation process or the like.

The afore-mentioned highly iodide-containing shell providing process is similarly applied to serve as the above-mentioned processes.

The outermost shell of the silver halide grains of the invention may be provided in such a manner that an intermediate shell is provided to the surface of a grain containing the above-mentioned intermediate shells, the highly iodide-containing shells and the inner core or, if required, the intermediate shell provided thereon with a single or plurality of arbitrary shells and, to the outside of the above-mentioned grain, a silver halide having a halogen composition different from those of the highly iodide-containing shells and the intermediate shells is further coated in a double-jet or controlled double-jet precipitation process or the like.

The aforementioned highly iodide-containing shell providing process is similarly applied to serve as the above-mentioned processes.

The arbitrary shells may be interposed singly or plurally, if required, between an inner core and a highly iodide-containing shell, the highly iodide-containing shell and an intermediate shell, and the intermediate shell and the outermost shell, respectively; and it is allowed not necessarily to interpose such an arbitrary shell.

The above-mentioned arbitrary shells may be provided in the same processes as in the case of providing the afore-mentioned highly iodide-containing shell. When trying to provide a shell adjacent to an inner core, a highly iodide-containing shell, an outermost shell or arbitrary shells provided to the respective positions, an ordinary desalting may also be carried out in the course of providing the adjacent shell, if required, or such shells may be continuously formed without carrying out any desalting.

Structural characteristics of the silver halide grains of the invention such as the iodide content of each coated shell of the silver halide grains may be obtained in such a method as described in, for example, J. I. Goldstein and D. B. Williams, 'X-Ray Analyses in TEM/ATEM'. Scanning Electron Microscopy, 1977, vol. 1, IIT Research Institute, p. 651, March, 1977; 'Annual Meeting of SPSTJ '84', p 49~51 (1984); 'The International East-West Symposium on the Factors Influencing Photographic Sensitivity (1984)', c-60~c-63 (1984); Japanese Patent O.P.I. Publication No. 143331/1985 and Japanese Patent O.P.I. Publication No. 143332.

It is allowed to remove an excessive halide or such a salt a compound as a nitrate, ammonia and the like which was by-produced or unnecessarily produced from the dispersion-medium of the grains which are the final products obtained after the outermost shell of the invention was formed. The suitable methods of removing the above-mentioned materials include, for example, a noodle washing method usually applied to an ordinary type emulsion; a dialysis method; a sedimentation method utilizing an inorganic salt, an anionic surfactant, such an anionic polymer as a polystyrene sulfonic acid, or such a gelatin derivative as an acylated or carbamoylated gelatin; a flocculation method; and the like.

The core/shell type silver halide grains of the invention can be optically sensitized to a desired wavelength region, and there is no special limitation to the optical sensitization methods. The grains may be optically sensitized by making use, independently or in combination, of such an optical sensitizer as cyanine or merocyanine dyes including, for example, zero-methine, monomethine, dimethine, trimethine and the like. A combination of spectrally sensitizing dyes is often used particularly for a supersensitization. An emulsion is also allowed to contain, as well as the above-mentioned spectrally sensitizing dyes, a dye having no spectrally sensitizing characteristic in itself or a substance substantially incapable of absorbing any visible rays of light but capable of displaying super-sensitizing characteristics. These technics are described in, for example, U.S. Pat. Nos. 2,688,545, 2,912,329, 3,397,060, 3,615,635 and 3,628,964; British Patent Nos. 1,195,320, 1,242,588 and 1,293,862; West German (OLS) Patent Nos. 2,030,326 and 2,121,780; Japanese Patent Examined Publication Nos. 4936/1968 and 14030/1969; Research Disclosure, vol. 176, No. 17643, published in Dec., 1978, p. 23, Paragraph IV, Item J; and the like. The above-mentioned technics may be optionally selected in accordance with a wavelength region, sensitivity and the like to which a sensitization is to be applied and with the purpose and use of a light-sensitive material.

The core/shell type silver halide crystals of the invention may also be treated in various chemical sensitization processes applicable to ordinary type emulsions.

The chemical sensitization may be carried out in such a process as described in, for example, H. Frieser, 'Die Grundlagen der Photographische Prozesse mit Silberhalogeniden', Akademische Verlagsgesselschaft, 1968, pp. 675~734. Namely, there may be used, independently or in combination, a sulfur sensitization process using therein a compound or active gelatin containing sulfur capable of reacting on silver ions; a reduction sensitization process using therein a reducible substance; a noble-metal sensitization process using therein gold and other noble-metal compounds; and the like. As for the sulfur sensitizers, a thiosulfate, a thiourea, a thiazole, a rhodanine and other compounds may be used. They typically include those described in U.S. Pat. Nos. 1,574,944, 2,410,689, 2,278,947, 2,728,668, 3,656,955, 4,032,928 and 4,067,740. As for the reduction sensitizers, a stannous salt, an amine, a hydrazine derivative, a formamidine sulfinic acid, a silane compound and the like may be used. They typically include those described in U.S. Pat. Nos. 2,487,850, 2,419,974, 2,518,698, 2,983,609, 2,983,610, 2,694,637, 3,930,867 and 4,054,458. For the noble-metal sensitization, a gold complex salt and besides the metal complex salts of the VIII group of the periodic table, such as platinum, iridium, palladium and the like may be used. They typically include those described in U.S. Pat. Nos. 2,399,083 and 2,448,060; British Patent No. 618,061; and the like.

The silver halide grains of the invention may be treated in a combination of not less than two of the above-mentioned chemical sensitization processes.

An amount of silver to be coated is not limited but preferably from not less than 1000mg/m$^2$ to not more than 15000mg/m$^2$ and, more preferably, from not less than 2000mg/m$^2$ to not more than 10000mg/m$^2$.

The light-sensitive layers each containing the above-mentioned grains may be present on both sides of a support.

When forming each of the shells of the core/shell type emulsions of the invention, various kinds of dopants may be doped. The inner dopants thereof include, for example, silver, sulfur, iridium, gold, platinum, osmium, rhodium, tellurium, selenium, cadmium, zinc, lead, thallium, iron, antimony, bismuth, arsenic and the like.

To dope the above-mentioned dopants, the water-soluble salts or complex salts thereof may be made coexist therewith when forming each of the shells.

As for the binders to be used in the core/shell type silver halide grains of the invention, or the dispersion medium to be used in the manufacturing process thereof, a hydrophilic colloid ordinarily used in a silver halide emulsion may also be used. As for the hydrophilic colloids mentioned above, there are not only a gelatin regardless of the lime- or acid-treated but also the following; namely, a gelatin derivative including, for example, those prepared through a reaction of gelatin on either one of an aromatic sulfonyl chloride, acid chloride, acid anhydride, isocyanate or 1,4-diketone, such as described in U.S. Pat. No. 2,614,928; a gelatin derivative prepared through a reaction of gelatin on a trimellitic acid anhydride, such as described in U.S. Pat. No. 3,118,766; a gelatin derivative prepared through a reaction of gelatin on an organic acid having an active halogen, such as described in Japanese Patent Examined Publication No. 5514/1964; a gelatin derivative prepared through a reaction of gelatin on an aromatic glycidyl ether, such as described in Japanese Patent Examined Publication No. 26845/1967; a gelatin derivative prepared through a reaction of gelatin on a maleimide, maleaminic acid or unsaturated aliphatic diamide and the like, such as described in U.S. Pat. No. 3,186,846; a sulfoalkylated gelatin described in British Patent No. 1,033,189; a polyoxyalkylene derivative of a gelatin described in U.S. Pat. No. 3,312,553: a graft gelatin polymer with acrylic acid, methacrilic acid or the esters thereof with a mono- or poly-valent alcohol; a graft gelatin polymer with an amide, acrylonitrile or methacrylonitrile, styrene, or other vinyl monomers used independently or in combination: a synthetic hydrophilic high molecular substance including, for example, a homopolymer comprising such a monomer as vinyl alcohol, N-vinylpyrolidone, hydroxyalkyl (metha)acrylate, (metha)acrylamide, N-substituted (metha)acrylamide or the like, or the copolymers prepared with each other homopolymers mentioned above, a copolymer prepared with either one of the above-mentioned substances and maleic acid anhydride, maleamic acid or the like: a natural hydrophilic high molecular substance other than gelatin including, for example, an independent or a combination of casein, agar and an alginic polysuccharide.

The silver halide photographic emulsions each containing the core/shell type silver halide grains of the invention is allowed to further contain various kinds of additives ordinarily used according to the purposes.

The above-mentioned additives include, for example, a stabilizer and an antifoggant such as an azole or an imidazole, e.g., a benzothiazolium salt, a nitroindazole, a nitrobenzimidazole, a chlorobenzimidazole, a bromobenzimidazole, a mercaptothiazole, a mercaptobenzthiazole, a mercaptobenzimidazole and a mercaptothiadiazole; a triazole, e.g., an aminotriazole, a benzotriazole and a nitrobenzotriazole; a tetrazole, e.g., a mercaptotetrazole, particularly including 1-phenyl-5-mercaptotetrazole and the like; a mercaptopyrimidine; a mercaptotriazine, e.g., a thioketo compound including oxazolinethione; an azaindene, e.g., a triazaindene, a tetraazaindene, particularly including a 4-hydroxy substituted-(1,3,3a,7)tetraazaindene, a pentaazaindene and the like; benzenethiosulfonic acid, benzenesulfinic acid, benzenesulfonic acid amide, an imidazolium salt, a tetrazolium salt, a polyhydroxy compound and the like.

In the photographic light-sensitive materials using therein the core/shell type emulsions of the invention, the photographic emulsion layers and the other hydrophilic colloidal layers thereof are allowed to contain inorganic or organic hardeners, independently or in combination, which include, for example, a chromium salt such as chrome alum, chromium acetate and the like; an aldehyde such as formaldehyde, glyoxal, glutaric aldehyde and the like; a N-methylol compound such as dimethylolurea, methyloldimethylhydantoine and the like; a dioxane derivative such as 2,3-dihydroxydioxane and the like; an active vinyl compound such as 1,3,5-triacryloyl-hexahydro-S-triazine, 1,3-vinylsulfonyl-2-propanol and the like; an active halide such as 2,4-dichloro-6-hydroxy-S-triazine and the like; a mucohalogen acid such as mucochloric acid, mucophenoxychloric acid and the like; and the like.

In the photographic light-sensitive materials using therein the core/shell type emulsions of the invention, the photographic emulsion layers and the other hydrophilic colloidal layers thereof are allowed to contain the dispersed matters of a water-insoluble or hardly soluble synthetic polymer with the purposes of improving the dimensional stability thereof and the like. There may be used the polymers, independently or in combination, including, for example, alkyl (metha)acrylate, alkoxyalkyl (metha)acrylate, glycidyl (metha)acrylate, (metha)acrylamide, a vinyl ester such as vinyl acetate, acrylonitrile, olefin, styrene and the like; or the polymers each having the monomer-components each comprising a combination of the above-mentioned dispersed matters and acrylic acid, methacrylic acid, $\alpha,\beta$-unsaturated dicarboxylic acid, hydroxyalkyl (metha)acrylate, sulfoalkyl (metha)acrylate, styrenesulfonic acid or the like.

The silver halide photographic light-sensitive materials relating to the invention are also allowed to contain, if required, a development accelerator such as benzyl alcohol, a polyoxyethylene compound and the like; an image stabilizer such as those of a chroman, coumaran, bisphenol or phosphorous acid ester; a lubricant such as a wax, glycerides of a higher fatty acid, the higher alcohol esters of a higher fatty acid and the like; a development regulator; a developing agent; a plasticizer; and a bleaching agent. As for the surfactants which are allowed to be contained therein, there may use a coating aid, a permeability improving agent for a processing liquid or the like, a defoaming agent or various materials of the anion, cation, non-ion or amphoteric type for controlling various physical properties of the light-sensitive materials. As for the antistatic agents, there may effectively use a diacetyl cellulose, a styrene perfluoroalkylsodium maleate copolymer, an alkali salt of the reaction products of a styrene-maleic anhydride copolymer and p-aminobenzenesulfonic acid, and the like. The matting agents include, for example, a polymethacrylic acid methyl, a polystyrene, an alkali-soluble polymer and the like. In addition, a colloidal silica oxide may also be used. The latexes to be added for improving the physical properties of layers include, for example, a copolymer of an acrylic ester, a vinyl ester or the like and a monomer having the other ethylene group. The gelatin plasticizers include, for example, glycerol and a glycol compound. The thickening agents include, for example, a styrene-sodium maleate copolymer, an alkylvinylether-maleic acid copolymer and the like.

The emulsions each having the silver halide grains of the invention may be provided with a wide latitude, if they are prepared by mixing at least two emulsions which are different from each other in average grain size and sensitivity.

The core/shell type silver halide emulsions relating to the invention may effectively be applied to the photographic light-sensitive materials for various applications such as a general black-and-white photography, X-ray photography, color photography, infrared photography, microphotography, silver dye bleach photographic process, reversal photography, diffusion transfer photographic process, high contrast photography, photothermography, heat processable light-sensitive materials, and the like. Inter alia, they are particularly suitable for a high speed color light-sensitive material.

When applying a core/shell type silver halide emulsion relating to the invention to color photographic light-sensitive material, the silver halide emulsion is to be treated in such a process as usually applied to a color light-sensitive material as well as with the materials therefor. In the above-mentioned process, cyan, magenta and yellow couplers are contained in the emulsions each having the aforementioned crystals and having been prepared to be red-, green- and blue-sensitive, respectively. The above-mentioned materials include, for example, the magenta couplers such as that of 5-pyrazolone, pyrazolobenzimidazole, pyrazolotriazole, cyanoacetylcoumaran, open-chained acylacetonitrile or the like; the yellow couplers such as that of acylacetoamide (e.g., a benzoylacetanilide and a pivaloylacetanilide) or the like; and the cyan couplers such as that of naphthol, phenol or the like. The above-mentioned couplers are desired to be the non-diffusible ones each having, in the molecules thereof, a hydrophobic group that is so-called ballast group. The couplers may be of either 4- or 2-equivalent per silver ion. They may also be colored couplers capable of displaying a color-compensation effect or couplers capable of releasing a development inhibitor while a development is being carried out, (which are called 'non-coloration DIR couplers'). The above-mentioned emulsions are also allowed to contain, besides the DIR couplers, a non-coloration DIR coupling compound which is capable of producing a colorless coupling reaction products and also releasing a development inhibitor.

When embodying the invention, the undermentioned well-known anti-discoloring agent may jointly be used, and color image stabilizers may also be used independently or in combination. Such anti-discoloring agents include, for example, a hydroquinone derivative, a gallic acid derivative, a p-alkoxyphenol, a p-oxyphenol derivative, a bisphenol and the like.

In the light-sensitive materials of the invention, the hydrophilic layers thereof may contain such a UV absorbing agent as a benzotriazole compound substituted by an aryl group, a 4-thiazolidone compound, a benzophenone compound, a cinnamic acid ester compound, a butadiene compound, a benzoxazole compound, a UV absorptive polymer, and the like. It is also allowed that such UV absorbing agents may be fixed into the above-mentioned hydrophilic colloidal layers.

In the light-sensitive materials of the invention, the hydrophilic layers thereof are allowed to contain a water-soluble dyestuff to serve as a filter dyestuff or with the various purposes of preventing an irradiation and the like.

Such dyes as mentioned above include, for example, an oxonol, hemioxonol, styryl, merocyanine, cyanine or azo dye. Among them, the hemioxonol dyes and the merocyanine dyes are particularly useful.

The light-sensitive materials of the invention are allowed to contain such anticolor-fogging agent as a hydroquione derivative, an aminophenol derivative, a gallic acid derivative, an ascorbic acid derivative and the like.

This invention may also be applied to a multilayered multicolor photographic light-sensitive material comprising a support bearing thereon at least two light-sensitive layers having different spectral sensitivity from each other. Generally, a multilayered color photographic material is provided, on the support thereof, with at least one each of red-, green- and blue-sensitive emulsion layers, respectively. The layer arrangement order may be freely selected according to the necessity. It is a usual combination to contain cyan forming couplers in a red-sensitive emulsion layer, magenta forming couplers in a green-sensitive emulsion layer and yellow forming couplers in a blue-sensitive emulsion layer, however, a different combination may also be adopted, if occasion demands.

In the photographic light-sensitive materials of the invention, the photographic emulsion layers and other hydrophilic colloidal layers thereof may be coated on the support or other layers thereof in various well-known coating methods such as a dip-coating method, a roller-coating method, a curtain-coating method, an extrusion-coating method and the like. The advantageous methods thereof are described in, for example, U.S. Pat. Nos. 2,681,294, 2,761,791 and 3,526,528.

The supports of the above-mentioned photographic light-sensitive materials include, for example, a baryta paper, a polyethylene-coated paper, a synthetic polypropylene paper, a glass plate, a cellulose acetate film, a cellulose nitrate film, a polyvinyl acetal film, a polypropylene film, a polyester film such as a polyethyleneterephthalate film, a polystyrene film, and the like, each of which is ordinarily used and may suitably be selected according to the purposes of using the photographic light-sensitive materials.

The above-mentioned supports may also be sublayered, if occasion demands.

The photographic light-sensitive materials containing the core/shell type silver halide emulsions relating to the invention may be exposed to light and, after then, developed in any well-known process being normally used.

A black-and-white developer is an alkaline solution containing such a developing agent as a hydroxybenzene, an aminophenol, an aminobenzene or the like and, beside the above, it is also allowed to contain a sulfite, carbonate, bisulfite, bromide or iodide each produced with an alkali metal salt. When the above-mentioned photographic light-sensitive material is for color photographic use, it may be color developed in any color developing process being normally used. In a reversal process, a development is made with a black-and-white developer at first, and a white-light exposure is applied or a treatment is made in a bath containing a fogging agent, and further a color-development is made with an alkaline developer containing a color developing agent. There is no particular limitation to the processes, but any processes may be applied. A typical example of such processes is that, after color-developing, a bleach-fixing is made and, if required, a washing and a stabilizing are then made; and the other example thereof is that, after color-developing, a bleaching and a fixing are separately made and, if required, a washing and a stabilizing are further made. Generally, a color developer comprises an aqueous alkaline solution containing a color developing agent. The color developing agents include, for example, such a well-known aromatic primary amine developer as a phenylenediamine, e.g., 4-amino-N,N-diethylaniline, 3-methyl-4-amino-N,N-diethyl aniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, and the like.

Besides the above, there may be able to use those described in, for example, L. F. A. Mason, 'Photographic Processing Chemistry', Focal Press, 1966, pp. 226–229; U.S. Pat. Nos. 2,193,015 and 2,592,364; Japanese Patent O.P.I. Publication No. 64933/1973; and the like.

The color developers are also allowed to contain a pH buffer, an antifoggant and the like, besides the above. They may further contain, if required, a water softener, a preserver, an organic solvent, a development accelerator, a dye forming coupler, a competing coupler, a fogging agent, an auxiliary developer, a thickener, a polycarboxylic acid chelating agent, an oxidation inhibitor and the like.

The photographic emulsion layers are ordinarily bleached after they were color-developed. Such bleaching process may be carried out either simultaneously with or separately from a fixing process. The bleaching agents for this purpose include, for example, the compounds of such a polyvalent metal as iron (III), cobalt (IV), chromium (VI), copper (II) and the like; a peroxy acid, a quinone, a nitroso compound, and the like.

It is allowed to add to a bleaching or bleach-fixing liquid with various additives as well as the bleaching accelerators such as those described in, for example, U.S. Pat. Nos. 3,042,520 and 3,241,966, Japanese patent Examined Publication Nos. 8506/1967 and 8836/1967, and the like; the thiol compounds such as those described in, for example, Japanese Patent O.P.I. Publication No. 65732/1978.

EXAMPLES

The following examples will further illustrate preferred preparation of the silver halide grains relating to the invention.

Preparation Examples of the silver halide grains

Preparation Example 1

(1-1) Preparation of Inner Core

By making use of the following six kinds of solutions, a silver iodide emulsion EM-I was prepared so as to contain silver iodide in an amount of 4 mol % thereof.

| | |
|---|---|
| (Solution A-1) | |
| Ossein gelatin | 39.7 g |
| Distilled water | 3,936 ml |
| A 10% ethanol solution of sodium polyisopropylene-polyethyleneoxy-disuccinate | 35.4 ml |
| Magnesium sulfate | 3.6 g |
| A 6% solution of nitric acid | 75.6 ml |
| Potassium bromide | 2.06 g |
| (Solution B-1) | |
| Ossein gelatin | 35.4 g |
| Potassium bromide | 807 g |
| Potassium iodide | 47 g |
| A 10% ethanol solution of sodium polyisopropylene-polyethyleneoxy-disuccinate | 35.4 ml |
| Distilled water | 1,432 ml |
| (Solution E-1) | |
| Silver nitrate | 1,200 g |
| A 6% solution of nitric acid | 62 ml |
| Distilled water | 1,467 ml |
| (Solution F-1) | |
| A 25% aqueous solution of KBr | An amount required for pAg value adjustment. |
| (Solution H-1) | |
| A 6% solution of nitric acid | An amount required for pH value adjustment. |
| (Solution I-1) | |
| A 7% aqueous solution of sodium carbonate | An amount required for pH value adjustment. |

Both Solutions of E-1 and B-1 were added to Solution A-1 in a double-jet precipitation method, at 40° C., by making use of a mixing stirrer described in Japanese Patent O.P.I. Publication Nos. 92523/1982 and 92524/1982. While the double-jet precipitation method was being applied, the pAg and pH value thereof and the adding rates of both Solutions of E-1 and B-1 were controlled as shown in Table 1. The pAg and pH values were controlled by adjusting the flow rates of both Solutions F-1 and H-1 by making use of a roller-tube pump capable of changing flow rates.

Three minutes after the addition of Solution E-1 was completed, a pH value of the resulted matter was adjusted with Solution I-1.

Next, the resulted matter was desalted and washed in an ordinary method and dispersed in an aqueous solution containing 125 g of ossein gelatin. After then, an aggregate amount of the dispersed matter was adjusted with distilled water to 4,800 ml.

It was observed with an electron microscope that the resulted emulsion was a monodispersed emulsion of 0.09 μm in average grain size. Hereinafter, the term, 'grain size', means a length of one side of a cube which is equivalent to a grain in volume.

TABLE 1

| Time (min) | Rate of adding solution (ml/min) Solution E-1 | Solution B-1 | pAg | pH |
|---|---|---|---|---|
| 0.00 | 15.9 | 15.9 | 9.0 | 2.0 |
| 1.50 | 15.9 | 15.9 | 9.0 | 2.0 |
| 2.00 | 15.9 | 15.2 | 9.0 | 2.0 |
| 5.00 | 15.9 | 15.2 | 9.0 | 2.0 |
| 10.30 | 29.1 | 28.4 | 9.0 | 2.0 |
| 13.72 | 39.8 | 39.1 | 9.0 | 2.0 |
| 16.37 | 49.2 | 48.5 | 9.0 | 2.0 |
| 17.95 | 55.0 | 54.3 | 9.0 | 2.0 |
| 18.65 | 57.8 | 57.1 | 9.0 | 2.0 |
| 20.55 | 65.7 | 65.0 | 9.0 | 2.0 |
| 22.25 | 73.2 | 72.5 | 9.0 | 2.0 |
| 25.20 | 87.2 | 86.3 | 9.0 | 2.0 |
| 26.50 | 93.8 | 92.9 | 9.0 | 2.0 |
| 27.70 | 100.2 | 99.9 | 9.0 | 2.0 |
| 28.85 | 106.3 | 105.3 | 9.0 | 2.0 |
| 29.95 | 112.3 | 111.1 | 9.0 | 2.0 |
| 30.95 | 118.1 | 117.0 | 9.0 | 2.0 |
| 31.92 | 123.8 | 122.6 | 9.0 | 2.0 |
| 32.10 | 124.8 | 123.5 | 9.0 | 2.0 |

(1-2) Provision of the 5th Shell

Emulsion EM-2 was prepared, by using the following 5 kinds of solution, in such a process that the above-mentioned Emulsion EM-1 was used as a seed emulsion to which silver iodobromide shells each having a silver iodide content of 2 mol % were provided.

| | |
|---|---|
| (Solution A-2) | |
| Ossein gelatin | 34.54 g |
| Distilled water | 8,642 ml |
| A 10% ethanol solution of sodium polyisopropylene-polyethyleneoxy-disuccinate | 20 ml |
| 4-hydroxy-6-methyl-1,3,3a,7-tetrazaindene | 181.32 mg |
| A 28% aqueous ammonia | 117.4 ml |
| A 56% aqueous solution of acetic acid | 154 ml |
| Magnesium sulfate | 16 g |
| Seed emulsion (EM-1) | An equivalent amount to 0.329 mol |
| (Solution B-2) | |
| Ossein gelatin | 18.72 g |
| KBr | 763.8 g |
| KI | 21.8 g |
| 4-hydroxy-6-methyl-1,3,3a,7-tetrazaindene | 2.17 g |
| Magnesium sulfate | 7.4 g |
| Distilled water | 1,578 ml |
| (Solution E-2) | |
| $AgNO_3$ | 1,142.4 g |
| A 28% aqueous ammonia | 931.4 ml |
| Add distilled water to make | 1,921 ml |
| (Solution F-2) | |
| A 50% aqueous solution of KBr | An amount required for pAg value adjustment. |
| (Solution G-2) | |
| A 56% aqueous solution of acetic acid | An amount required for pH value adjustment. |

Both Solutions of E-2 and B-2 were added to Solution A-2 in a double-jet precipitation method, at 40° C., by making use of a mixing stirrer described in Japanese Patent O.P.I. Publication Nos. 92523/1982 and 92524/1982, by taking a time for 32.5 minutes at a minimum so as not to produce any small grains during the addition thereof. While the double-jet precipitation method was being applied, the pAg and pH value thereof and the adding rates of both Solutions of E-2 and B-2 were controlled as shown in Table 2. The pAg and pH values were controlled by adjusting the flow rates of Solutions F-2, G-2 and B-2 by making use of a roller-tube pump capable of changing flow rates.

After the addition of Solution E-2 was completed, the pAg value was adjusted to 10.4 with Solution G-2 and, two minutes after then, the pH value was adjusted to 6.0 with Solution F-2, respectively.

TABLE 2

| Time (min) | Rate of adding solution (ml/min) Solution E-2 | Solution B-2 | pAg | pH |
|---|---|---|---|---|
| 0.00 | 16.24 | 15.44 | 8.50 | 8.00 |
| 5.43 | 41.87 | 40.15 | 8.54 | 7.95 |
| 8.17 | 60.36 | 58.69 | 8.58 | 7.88 |
| 10.88 | 76.58 | 74.98 | 8.64 | 7.78 |
| 13.62 | 83.78 | 82.24 | 8.71 | 7.66 |
| 16.33 | 81.82 | 80.33 | 8.78 | 7.53 |
| 19.07 | 75.04 | 73.56 | 8.84 | 7.42 |
| 21.78 | 66.98 | 65.53 | 8.90 | 7.31 |
| 24.51 | 59.36 | 57.93 | 8.95 | 7.22 |
| 26.83 | 53.65 | 51.93 | 8.99 | 7.15 |
| 29.97 | 49.56 | 47.82 | 9.00 | 7.06 |
| 32.48 | 46.47 | 44.71 | 9.00 | 7.00 |

Next, the resulted matter was desalted and washed in an ordinary process, and was dispersed in an aqueous solution containing 128.6 g of ossein gelatin. After then, an aggregate amount thereof was adjusted to 3,000 ml with distilled water.

It was observed with an electron microscrope that the resulted emulsion was an excellent monodispersed emulsion of 0.27 μm in average grain size and of 12% in the variation coefficient of grain size distribution.

(1-3) Provision of the 4th Shell

Emulsion EM-3 was prepared, by using the following 5 kinds of solution, in such a process that the above-mentioned Emulsion EM-2 was used as a seed emulsion to which silver iodobromide shells each having a silver iodide content of 2.6 mol % were provided.

| | |
|---|---|
| (Solution A-3) | |
| Ossein gelatin | 34.0 g |
| Distilled water | 7,779 ml |
| A 10% ethanol solution of sodium polyisopropylene-polyethyleneoxy-disuccinate | 20 ml |
| 4-hydroxy-6-methyl-1,3,3a,7-tetrazaindene | 405 mg |
| A 28% aqueous ammonia | 117.3 ml |
| A 56% aqueous solution of acetic acid | 72 ml |
| Seed emulsion (EM-2) | An equivalent amount to 0.303 mol |
| (Solution B-3) | |
| Ossein gelatin | 18.74 g |
| KBr | 760.2 g |
| KI | 28.4 g |
| 4-hydroxy-6-methyl-1,3,3a,7-tetrazaindene | 1.35 g |
| Distilled water | 1,574 ml |
| (Solution E-3) | |
| $AgNO_3$ | 1,148 g |
| A 28% aqueous ammonia | 937 ml |
| Add distilled water to make | 1,930 ml |
| (Solution F-3) | |
| A 50% aqueous solution of KBr | An amount required for pAg value adjustment. |

-continued

| (Solution G-3) | |
|---|---|
| A 56% aqueous solution of acetic acid | An amount required for pH value adjustment. |

Both Solutions of E-3 and B-3 were added to Solution A-3 in a double-jet precipitation method, at 40° C., by making use of a mixing stirrer described in Japanese Patent O.P.I. Publication Nos. 92523/1982 and 92524/1982, by taking a time for 56.5 minutes at a minimum so as not to produce any small grains during the addition thereof. While the double-jet precipitation method was being applied, the pAg and pH values thereof and the adding rates of both Solutions of E-3 and B-3 were controlled as shown in Table 3. The pAg and pH values were controlled by adjusting the flow rates of Solutions F-3, G-3 and B-3 by making use of a roller-tube pump capable of changing flow rates.

Two minutes after the addition of Solution E-3 was completed, the pAg value was adjusted to 10.4 with Solution G-3 and, two minutes after then, the pH value was adjusted to 6.0 with Solution F-3, respectively.

Next, the resulted matter was desalted and washed in an ordinary process, and was dispersed in an aqueous solution containing 128.1 g of ossein gelatin. After then, an aggregate amount thereof was adjusted to 3,000 ml with distilled water.

It was observed with an electron microscope that the resulted emulsion was an excellent monodispersed emulsion of 0.80 μm in average grain size and of 10% in the variation coefficient of grain size distribution.

TABLE 3

| Time (min) | Rate of adding solution (ml/min) Solution E-3 | Solution B-3 | pAg | pH |
|---|---|---|---|---|
| 0.00 | 5.77 | 5.49 | 9.0 | 9.00 |
| 9.43 | 10.29 | 9.79 | 9.0 | 8.96 |
| 14.17 | 13.91 | 13.24 | 9.0 | 8.93 |
| 18.88 | 18.96 | 18.04 | 9.0 | 8.88 |
| 23.62 | 25.91 | 24.65 | 9.0 | 8.83 |
| 28.33 | 35.09 | 33.81 | 9.0 | 8.76 |
| 33.05 | 44.20 | 42.92 | 9.0 | 8.66 |
| 37.78 | 53.27 | 52.01 | 9.0 | 8.54 |
| 42.50 | 55.56 | 54.31 | 9.0 | 8.40 |
| 47.23 | 56.37 | 55.12 | 9.0 | 8.27 |
| 51.95 | 58.00 | 56.75 | 9.0 | 8.13 |
| 56.53 | 56.01 | 54.76 | 9.0 | 8.00 |

(1-4) Provision of Highly iodide-containing Shell, Intermediate Shell and the Outermost Shell of the Invention Emulsion EM-4 was prepared, by using the following 7 kinds of solutions, in such a process that the above-mentioned Emulsion EM-3 was used as a seed emulsion to which a highly iodide-containing shell, an intermediate shell and the outermost shell were provided.

| (Solution A-4) | |
|---|---|
| Ossein gelatin | 22.5 g |
| Distilled water | 6,884 ml |
| A 10% ethanol solution of sodium polyisopropylene-polyethyleneoxy-disuccinate | 20 ml |
| 4-hydroxy-6-methyl-1,3,3a,7-tetrazaindene | Amount shown in Table-4 |
| A 28% aqueous ammonia | 469 ml |
| A 56% aqueous solution of acetic acid | 258 ml |
| Seed emulsion (EM-3) | An equivalent amount to 0.8828 mol |

-continued

| (Solution B-4) | |
|---|---|
| Ossein gelatin | 24 g |
| KBr | Amount shown in Table-5 |
| KI | Amount shown in Table-5 |
| 4-hydroxy-6-methyl-1,3,3a,7-tetrazaindene | Amount shown in Table-5 |
| Distilled water | 1,978 ml |
| (Solution C-4) | |
| Ossein gelatin | 24 g |
| KBr | Amount shown in Table-6 |
| KI | Amount shown in Table-6 |
| 4-hydroxy-6-methyl-1,3,3a,7-tetrazaindene | Amount shown in Table-6 |
| Distilled water | 1,978 ml |
| (Solution D-4) | |
| Ossein gelatin | 40 g |
| KBr | Amount shown in Table-7 |
| KI | Amount shown in Table-7 |
| 4-hydroxy-6-methyl-1,3,3a,7-tetrazaindene | Amount shown in Table-7 |
| Distilled water | 3,296 ml |
| (Solution E-4) | |
| $AgNO_3$ | 1,109 g |
| A 28% aqueous ammonia | 904 ml |
| Add distilled water to make | 1,866 ml |
| (Solution F-4) | |
| A 50% aqueous solution of KBr | An amount required for pAg value adjustment |
| (Solution G-4) | |
| A 56% aqueous solution of acetic acid | An amount required for pH value adjustment |

Both Solutions of E-4 and B-4 were added to Solution A-4 in a double-jet precipitation method, at 50° C., by making use of a mixing stirrer described in Japanese Patent O.P.I. Publication Nos. 92523/1982 and 92524/1982, by taking a time for 46.6 minutes. At the same time when the addition of Solution B-4, Solution C-4 was added thereto. After 35.9 minutes, that was at the time when the addition of Solution C-4 was completed, Solution D-4 was added thereto and after 25.5 minutes, the addition of Solution D-4 was completed. While the double-jet precipitation method was being applied, the pAg and pH values thereof and the adding rates of the solutions of E-4, B-4, C-4 and D-4 were controlled as shown in Table-8. The pAg and pH values were controlled by adjusting the flow rates of Solutions F-4 and G-4 by making use of a roller-tube pump capable of changing flow rates.

Two minutes after the addition of Solution E-4 was completed, the pAg value thereof was adjusted to 10.4 by Solution F-4 and, after two minutes, the pH value thereof was further adjusted to 6.0 by Solution G-4, respectively.

Next, the resulted matter was desalted and washed in an ordinary process and was dispersed in an aqueous solution containing 127 g of ossein gelatin. After then, the resulted dispersed matter was adjusted to an aggregate amount of 3,000 ml with distilled water.

It was observed with a electron microscope that the resulted emulsion was an excellent monodispersed emulsion of 1.60 μm in average grain size and of 11% in the variation coefficient of grain size distribution.

The emulsion EM-4 is a core/shell type silver iodobromide emulsion having the silver iodide contents of 15 mol %, 5 mol % and 0.3 mol % in the order arranged from the inside of each grain. (i.e., Il=0.3, Ih=0.5 and Im=5, respectively)

TABLE 4

| Emulsion No. | Content of Solution A-4: 4-hydroxy-6-methyl-1,3,3a,7-tetrazaindene (mg) |
|---|---|
| EM-4 | 646 |
| EM-5 | 646 |
| EM-6 | 646 |
| EM-7 | 646 |
| EM-8 | 646 |
| EM-9 | 646 |
| EM-10 | 646 |
| EM-11 | 646 |
| EM-12 | 646 |
| EM-13 | 646 |
| EM-14 | 646 |
| EM-15 | 646 |
| EM-16 | 646 |
| EM-17 | 646 |
| EM-18 | 646 |
| EM-19 | 646 |
| EM-20 | 646 |
| EM-21 | 646 |
| EM-22 | 646 |
| EM-23 | 646 |
| EM-24 | 646 |
| EM-25 | 646 |
| EM-26 | 646 |
| EM-27 | 646 |
| EM-28 | 323 |
| EM-29 | 323 |
| EM-30 | 323 |
| EM-31 | 323 |
| EM-32 | 646 |
| EM-33 | 646 |
| EM-34 | 646 |
| EM-35 | 646 |
| EM-36 | 646 |
| EM-37 | 646 |
| EM-38 | 646 |
| EM-39 | 646 |

TABLE 5

| Emulsion No. | Content of Solution B-4: 4-hydroxy-6-methyl-1,3,3a,7-tetra-zaindene (mg) | KBr (g) | KI (g) | KI/(KBr + KI) mol % |
|---|---|---|---|---|
| EM-4 | 2560 | 848 | 209 | 15 |
| EM-5 | 2560 | 848 | 209 | 15 |
| EM-6 | 2560 | 848 | 209 | 15 |
| EM-7 | 2560 | 848 | 209 | 15 |
| EM-8 | 2560 | 848 | 209 | 15 |
| EM-9 | 2560 | 848 | 209 | 15 |
| EM-10 | 2560 | 948 | 69.7 | 5 |
| EM-11 | 2560 | 918 | 111 | 8 |
| EM-12 | 2560 | 898 | 139 | 10 |
| EM-13 | 2560 | 798 | 278 | 20 |
| EM-14 | 2560 | 698 | 418 | 30 |
| EM-15 | 2560 | 598 | 557 | 40 |
| EM-16 | 2560 | 598 | 557 | 40 |
| EM-17 | 2560 | 498 | 697 | 50 |
| EM-18 | 2560 | 498 | 697 | 50 |
| EM-19 | 2560 | 848 | 209 | 15 |
| EM-20 | 2560 | 848 | 209 | 15 |
| EM-21 | 2560 | 848 | 209 | 15 |
| EM-22 | 2560 | 848 | 209 | 15 |
| EM-23 | 2560 | 848 | 209 | 15 |
| EM-24 | 2560 | 848 | 209 | 15 |
| EM-25 | 2560 | 848 | 209 | 15 |
| EM-26 | 2560 | 748 | 348 | 25 |
| EM-27 | 2560 | 848 | 209 | 15 |
| EM-28 | 1280 | 848 | 209 | 15 |
| EM-29 | 1280 | 848 | 209 | 15 |
| EM-30 | 1280 | 848 | 209 | 15 |
| EM-31 | 1280 | 848 | 209 | 15 |
| EM-32 | 2560 | 848 | 209 | 15 |
| EM-33 | 2560 | 848 | 209 | 15 |
| EM-34 | 2560 | 848 | 209 | 15 |
| EM-35 | 2560 | 748 | 348 | 25 |
| EM-36 | 2560 | 648 | 488 | 35 |
| EM-37 | 2560 | 648 | 488 | 35 |

TABLE 5-continued

| Emulsion No. | Content of Solution B-4: 4-hydroxy-6-methyl-1,3,3a,7-tetra-zaindene (mg) | KBr (g) | KI (g) | KI/(KBr + KI) mol % |
|---|---|---|---|---|
| EM-38 | 2560 | 918 | 111 | 8 |
| EM-39 | 2560 | 918 | 111 | 8 |

TABLE 6

| Emulsion No. | Content of Solution C-4: 4-hydroxy-6-methyl-1,3,3a,7-tetra-zaindene (mg) | KBr (g) | KI (g) | KI/(KBr + KI) mol % |
|---|---|---|---|---|
| EM-4 | 2560 | 948 | 69.7 | 5 |
| EM-5 | 2560 | 848 | 209 | 15 |
| EM-6 | 2560 | 868 | 181 | 13 |
| EM-7 | 2560 | 898 | 139 | 10 |
| EM-8 | 2560 | 978 | 27.9 | 2 |
| EM-9 | 2560 | 996 | 4.18 | 0.3 |
| EM-10 | 2560 | 948 | 69.7 | 5 |
| EM-11 | 2560 | 948 | 69.7 | 5 |
| EM-12 | 2560 | 948 | 69.7 | 5 |
| EM-13 | 2560 | 948 | 69.7 | 5 |
| EM-14 | 2560 | 948 | 69.7 | 5 |
| EM-15 | 2560 | 948 | 69.7 | 5 |
| EM-16 | 2560 | 996 | 4.18 | 0.3 |
| EM-17 | 2560 | 948 | 69.7 | 5 |
| EM-18 | 2560 | 996 | 4.18 | 0.3 |
| EM-19 | 2560 | 948 | 69.7 | 5 |
| EM-20 | 2560 | 948 | 69.7 | 5 |
| EM-21 | 2560 | 948 | 69.7 | 5 |
| EM-22 | 2560 | 948 | 69.7 | 5 |
| EM-23 | 2560 | 898 | 139 | 10 |
| EM-24 | 2560 | 898 | 139 | 10 |
| EM-25 | 2560 | 898 | 139 | 10 |
| EM-26 | 2560 | 828 | 237 | 17 |
| EM-27 | 2560 | 948 | 69.7 | 5 |
| EM-28 | 1280 | 948 | 69.7 | 5 |
| EM-29 | 1280 | 996 | 4.18 | 0.3 |
| EM-30 | 1280 | 948 | 69.7 | 5 |
| EM-31 | 1280 | 996 | 4.18 | 0.3 |
| EM-32 | 2560 | 948 | 69.7 | 5 |
| EM-33 | 2560 | 948 | 69.7 | 5 |
| EM-34 | 2560 | 948 | 69.7 | 5 |
| EM-35 | 2560 | 898 | 139 | 10 |
| EM-36 | 2560 | 898 | 139 | 10 |
| EM-37 | 2560 | 924 | 104 | 7.5 |
| EM-38 | 2560 | 956 | 55.7 | 4 |
| EM-39 | 2560 | 996 | 4.18 | 0.3 |

TABLE 7

| Emulsion No. | Content of Solution D-4: 4-hydroxy-6-methyl-1,3,3a,7-tetra-zaindene (mg) | KBr (g) | KI (g) | KI/(KBr + KI) mol % |
|---|---|---|---|---|
| EM-4 | 4268 | 1660 | 6.97 | 0.3 |
| EM-5 | 4268 | 1660 | 6.97 | 0.3 |
| EM-6 | 4268 | 1660 | 6.97 | 0.3 |
| EM-7 | 4268 | 1660 | 6.97 | 0.3 |
| EM-8 | 4268 | 1660 | 6.97 | 0.3 |
| EM-9 | 4268 | 1660 | 6.97 | 0.3 |
| EM-10 | 4268 | 1660 | 6.97 | 0.3 |
| EM-11 | 4268 | 1660 | 6.97 | 0.3 |
| EM-12 | 4268 | 1660 | 6.97 | 0.3 |
| EM-13 | 4268 | 1660 | 6.97 | 0.3 |
| EM-14 | 4268 | 1660 | 6.97 | 0.3 |
| EM-15 | 4268 | 1660 | 6.97 | 0.3 |
| EM-16 | 4268 | 1660 | 6.97 | 0.3 |
| EM-17 | 4268 | 1660 | 6.97 | 0.3 |
| EM-18 | 4268 | 1660 | 6.97 | 0.3 |
| EM-19 | 4268 | 1660 | 0 | 0 |
| EM-20 | 4268 | 1657 | 11.6 | 0.5 |
| EM-21 | 4268 | 1641 | 34.8 | 1.5 |
| EM-22 | 4268 | 1591 | 104 | 4.5 |
| EM-23 | 4268 | 1641 | 34.8 | 1.5 |
| EM-24 | 4268 | 1591 | 104 | 4.5 |
| EM-25 | 4268 | 1532 | 185 | 8 |

TABLE 7-continued

| Emulsion No. | Content of Solution D-4: 4-hydroxy-6-methyl-1,3,3a,7-tetra-zaindene (mg) | KBr (g) | KI (g) | KI/(KBr + KI) mol % |
|---|---|---|---|---|
| EM-26 | 4268 | 1482 | 255 | 11 |
| EM-27 | 4268 | 1660 | 6.97 | 0.3 |
| EM-28 | 2134 | 1660 | 6.97 | 0.3 |
| EM-29 | 2134 | 1660 | 6.97 | 0.3 |
| EM-30 | 2134 | 1660 | 6.97 | 0.3 |
| EM-31 | 2134 | 1660 | 6.97 | 0.3 |
| EM-32 | 4268 | 1660 | 6.97 | 0.3 |
| EM-33 | 4268 | 1660 | 6.97 | 0.3 |
| EM-34 | 4268 | 1660 | 6.97 | 0.3 |
| EM-35 | 4268 | 1581 | 115 | 5 |
| EM-36 | 4268 | 1581 | 115 | 5 |
| EM-37 | 4268 | 1581 | 115 | 5 |
| EM-38 | 4268 | 1660 | 6.97 | 0.3 |
| EM-39 | 4268 | 1660 | 6.97 | 0.3 |

TABLE 8

| Time (min) | Rate of adding solution (ml/min): E-4 | B-4 | C-4 | D-4 | pAg | pH |
|---|---|---|---|---|---|---|
| 0.00 | 7.07 | 7.00 | — | — | 8.70 | 9.00 |
| 18.00 | 8.89 | 8.80 | — | — | 8.70 | 9.00 |
| 27.00 | 9.75 | 9.65 | — | — | 8.70 | 9.00 |
| 36.00 | 10.55 | 10.45 | — | — | 8.70 | 9.00 |
| 45.00 | 11.29 | 11.18 | — | — | 8.70 | 9.00 |
| 46.60 | 11.51 | 11.40 | 11.40 | — | 8.70 | 9.00 |
| 54.80 | 16.44 | — | 18.12 | — | 8.93 | 8.86 |
| 63.05 | 21.38 | — | 24.73 | — | 9.30 | 8.66 |
| 72.05 | 32.84 | — | 60.87 | — | 9.96 | 8.31 |
| 75.50 | 26.31 | — | 54.69 | — | 10.19 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

Preparation Example 2

The emulsions, EM-5, EM-6, EM-7, EM-8 and EM-9, were prepared in the same manner as in (1-4) of the above-mentioned preparation example, except that there used the 7 kinds of solutions described in (1-4) of the preparation example and added KBr, KI and 4-hydroxy-6-methyl-1,3,3a,7-tetrazaindene in the amounts designated in Tables 4, 5, 6 and 7, respectively.

The resulted emulsions were the monodispersed emulsions each of 1.60 μm in average grain size and their variation coefficients of grain size distribution were 17%, 15%, 12%, 16% and 16%, respectively.

Preparation Example 3

The emulsions, EM-10 through EM-26, were prepared in the same manner as in (1-4) of the Preparation Example 1, except that the 7 kinds of solutions designated in the Preparation Example 1 and, KBr, KI and 4-hydroxy-6-methyl-1,3,3a,7-tetrazaindene were used in the amounts designated in Tables 4, 5, 6 and 7, respectively.

These emulsions were the monodispersed having the average grain size of 1.60 μm and the variation coefficients of the grain size distributions of 10%, 10%, 11%, 12%, 13%, 18%, 19%, 35%, 39%, 10%, 11%, 11%, 11%, 12%, 12%. 12% and 13%. respectively.

Preparation Example 4

The emulsions, EM-28 and EM-29, were prepared in the same manner as in (1-4) of the Preparation Example 1, except that the 7 kinds of solutions designated in the Preparation Example 1 and, KBr, KI and 4-hydroxy-6-methyl-1,3,3a,7-tetrazaindene were used in the amounts designated in Tables 4, 5, 6 and 7, respectively.

Further, the Emulsion EM-27 was prepared in such a manner that the pAg and pH values and adding rates thereof were changed to those designated in Table-9 in the course of the mixation thereof; and the Emulsions EM-30 and 31 were also prepared as shown in Table-10.

The above-mentioned emulsions were the monodispersed having the average grain size of 1.6 μm and the variation coefficients of the grain size distributions of 9%, 18%, 19%, 32% and 34%, respectively.

TABLE 9

| Time (min) | Rate of adding solution (ml/min): E-4 | B-4 | C-4 | D-4 | pAg | pH |
|---|---|---|---|---|---|---|
| 0.00 | 7.07 | 7.00 | — | — | 8.70 | 9.00 |
| 18.00 | 8.89 | 8.80 | — | — | 8.70 | 9.00 |
| 27.00 | 9.75 | 9.65 | — | — | 8.70 | 9.00 |
| 36.00 | 10.55 | 10.45 | — | — | 8.70 | 9.00 |
| 45.00 | 11.29 | 11.18 | — | — | 8.70 | 9.00 |
| 46.60 | 11.51 | 11.40 | 11.40 | — | 8.70 | 9.00 |
| 54.80 | 16.44 | — | 18.12 | — | 8.93 | 8.86 |
| 63.05 | 21.38 | — | 24.73 | — | 9.30 | 8.66 |
| 72.05 | 32.84 | — | 60.87 | — | 9.96 | 8.31 |
| 75.50 | 26.31 | — | 54.69 | — | 10.00 | 8.21 |
| 82.50 | 24.12 | — | 23.88 | 23.88 | 10.00 | 8.04 |
| 90.06 | 21.89 | — | — | 21.67 | 10.00 | 7.86 |
| 99.08 | 20.13 | — | — | 19.93 | 10.00 | 7.66 |
| 108.00 | 19.25 | — | — | 19.06 | 10.00 | 7.50 |

TABLE 9

| Time (min) | Rate of adding solution (ml/min): E-4 | B-4 | C-4 | D-4 | pAg | pH |
|---|---|---|---|---|---|---|
| 0.00 | 7.07 | 7.00 | — | — | 10.20 | 9.00 |
| 18.00 | 8.89 | 8.80 | — | — | 10.20 | 9.00 |
| 27.00 | 9.75 | 9.65 | — | — | 10.20 | 9.00 |
| 36.00 | 10.55 | 10.45 | — | — | 10.20 | 9.00 |
| 45.00 | 11.29 | 11.18 | — | — | 10.20 | 9.00 |
| 46.60 | 11.51 | 11.40 | 11.40 | — | 10.20 | 9.00 |
| 54.80 | 16.44 | — | 18.12 | — | 10.20 | 8.86 |
| 63.05 | 21.38 | — | 24.73 | — | 10.20 | 8.66 |
| 72.05 | 32.84 | — | 60.87 | — | 10.20 | 8.31 |
| 75.50 | 26.31 | — | 54.69 | — | 10.20 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

Preparation Example 5

The emulsion EM-32 was prepared in the same manner as in (1-4) of the Preparation Example 1, except that the 7 kinds of solutions designated in the Preparation Example 1 and, KBr, KI and 4-hydroxy-6-methyl-1,3,3a,7-tetrazaindene were used in the amounts designated in Tables 4, 5, 6 and 7, respectively, and the pAg and pH values and adding rates of E-4, B-4, C-4 and D-4 thereof were further changed to those designated in Table-11 in the course of the mixation thereof; and the Emulsion EM-33 was prepared as shown in Table-12. and Emulsion EM-34 was further prepared as shown in Table-13, respectively. The above-mentioned emulsions were the monodispersed having the average grain size of 1.6 μm and the variation coefficients of the grain size distributions of 10%, 10% and 12%, respectively.

TABLE 11

| Time (min) | Rate of adding solution (ml/min): E-4 | B-4 | C-4 | D-4 | pAg | pH |
|---|---|---|---|---|---|---|
| 0.00 | 7.07 | 7.00 | — | — | 8.70 | 9.00 |
| 18.00 | 8.89 | 8.80 | — | — | 8.70 | 9.00 |
| 27.00 | 9.75 | 9.65 | — | — | 8.70 | 9.00 |

TABLE 11-continued

| Time (min) | Rate of adding solution (ml/min) E-4 | B-4 | C-4 | D-4 | pAg | pH |
|---|---|---|---|---|---|---|
| 28.50 | 9.89 | 9.80 | 9.80 | — | 8.70 | 9.00 |
| 36.00 | 10.55 | — | 10.45 | — | 8.70 | 9.00 |
| 45.00 | 11.29 | — | 11.18 | — | 8.70 | 9.00 |
| 46.60 | 11.51 | — | 11.40 | — | 8.70 | 9.00 |
| 54.80 | 16.44 | — | 18.12 | — | 8.93 | 8.86 |
| 63.05 | 21.38 | — | 24.73 | — | 9.30 | 8.66 |
| 72.05 | 32.84 | — | 60.87 | — | 9.96 | 8.31 |
| 75.50 | 26.31 | — | 54.69 | — | 10.19 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

TABLE 12

| Time (min) | Rate of adding solution (ml/min) E-4 | B-4 | C-4 | D-4 | pAg | pH |
|---|---|---|---|---|---|---|
| 0.00 | 7.07 | 7.00 | — | — | 8.70 | 9.00 |
| 13.90 | 8.47 | 8.39 | 8.39 | — | 8.70 | 9.00 |
| 18.00 | 9.75 | — | 9.65 | — | 8.70 | 9.00 |
| 27.00 | 9.89 | — | 9.80 | — | 8.70 | 9.00 |
| 36.00 | 10.55 | — | 10.45 | — | 8.70 | 9.00 |
| 45.00 | 11.29 | — | 11.18 | — | 8.70 | 9.00 |
| 46.60 | 11.51 | — | 11.40 | — | 8.70 | 9.00 |
| 54.80 | 16.44 | — | 18.12 | — | 8.93 | 8.86 |
| 63.05 | 21.38 | — | 24.73 | — | 9.30 | 8.66 |
| 72.05 | 32.84 | — | 60.87 | — | 9.96 | 8.31 |
| 75.50 | 26.31 | — | 54.69 | — | 10.19 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

TABLE 13

| Time (min) | Rate of adding solution (ml/min) E-4 | B-4 | C-4 | D-4 | pAg | pH |
|---|---|---|---|---|---|---|
| 0.00 | 7.07 | 7.00 | — | — | 8.70 | 9.00 |
| 18.00 | 8.89 | 8.80 | — | — | 8.70 | 9.00 |
| 27.00 | 9.75 | 9.65 | — | — | 8.70 | 9.00 |
| 36.00 | 10.55 | 10.45 | — | — | 8.70 | 9.00 |
| 45.00 | 11.29 | 11.18 | — | — | 8.70 | 9.00 |
| 46.60 | 11.51 | 11.40 | — | — | 8.70 | 9.00 |
| 54.80 | 16.44 | 18.12 | — | — | 8.93 | 8.86 |
| 63.05 | 21.38 | 24.73 | — | — | 9.30 | 8.66 |
| 68.85 | 28.76 | 48.02 | 48.02 | — | 9.72 | 8.43 |
| 72.05 | 32.84 | — | 60.87 | — | 9.96 | 8.31 |
| 75.50 | 26.31 | — | 54.69 | — | 10.19 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

Preparation Example 6

The emulsions EM-35, EM-36 and EM-37 were prepared in the same manner as in (1-4) of the Preparation Example 1, except that the 7 kinds of solutions designated in the Preparation Example 1 and, KBr, KI and 4-hydroxy-6-methyl-1,3,3a,7-tetrazaindene were used in the amounts designated in Tables 4, 5, 6 and 7, respectively.

Further, the Emulsions EM-38 and EM-39 were prepared in such a manner that the pAg and pH values and adding rates of E-4, B-4, C-4 and D-4 thereof were changed to those designated in Table 12 in the course of the mixation thereof.

The above-prepared emulsions were the monodispersed having the average grain size of 1.6 μm and variation coefficients of the grain size distributions of 12%, 14%, 13%, 9% and 11%, respectively.

E. Examples for the preparation of the photographic light-sensitive materials:

Next, the examples of the invention will now be described in detail.

Example 1

The effects of an intermediate shell are displayed by making use of the above-mentioned Emulsions EM-5, EM-6, EM-7, EM-4, EM-8 and EM-9.

Each effect thereof on sensitivity, fog, graininess, exposure range, sharpness and interlayer sensitivity was examined.

The effects thereof on the sensitivity, fog, graininess, exposure range and sharpness were measured with monolayered samples prepared for this purpose.

The effects on the multilayer sensitivity were examined with a multilayered color light-sensitive material having three light-sensitive layers, a blue light-sensitive layer, a green light-sensitive layer and a red light-sensitive layer.

Next, the processes of preparing the samples and the methods of measuring the characteristics of the samples will now be described below: Preparation of a single-color sensitive coating sample (called a monolayed sample):

Herein, the description will be made about the case that the invention was applied to the sample comprising a light-sensitive material having two layers, one is an emulsion-coated layer containing a coupler and the other is a protective layer.

In this example, a magenta-color forming coupler was used. Namely, 1-(2,4,6-trichlorophenyl)-3-[3-(2,4-di-t-amylphenoxyacetamido)benzamido]-5-pyrazolone was used in this example to serve as the magenta color forming coupler.

Therein, tricresyl phosphate (TCP) was used to serve as the high boiling solvent for dissolving the couplers.

The couplers were oil-protect-dispersed in an ordinary process.

The silver iodobromide emulsions (EM-4 through EM-9) described in the afore-mentioned preparation examples were chemically sensitized in an ordinary process and were further green-color-sensitized, when they were being chemically sensitized, with a green-color-sensitive spectral sensitizer in an ordinary process.

Each of the layers of this example was prepared in the following manners: 1st layer . . .

A high-speed green-sensitive emulsion layer containing 1.9g of the above-described silver iodobromide emulsions which were chemically sensitized and color-sensitized, and a dispersed matter comprising 1.9 g of gelatin and 0.06 g of DNP (which stands for ditertiary nonyl phenol) dissolving 0.20 g of the magenta coupler and 0.04 g of a colored magenta coupler. 2nd layer . . .

A yellow-filter layer containing 0.15 g of yellow colloidal silver, 0.11 g of DBP (which stands for dibutyl-terephthalate) dispersed matter in which 0.2 g of an anti-contaminating agent was dissolved and 1.5 g of gelatin;

Each of the above-mentioned two layers was added with a gelatin hardener and a surface active agent, as well as the above-mentioned compositions.

For measuring the sensitometric characteristics and the graininess, each of the samples was exposed to light through a wedge in an ordinary method; and for measuring the graininess, each of the samples was exposed to light through a square wave frequency wedge; and each of them was processed in the following steps:

| | |
|---|---|
| Color-developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The composition of the processing liquids used in the above-mentioned processing steps are shown below:

| | |
|---|---|
| [Color developer] | |
| 4-amino-3-methyl-N-(β-hydroxyethyl)-aniline.sulfate | 4.57 g |
| Sodium sulfite, anhydrated | 4.25 g |
| Hydroxylamine ½ sulfate | 2.0 g |
| Potassium carbonate, anhydrated | 37.5 g |
| Sodium bromide | 1.3 g |
| Trisodium nitrilotriacetate, monohydrated | 2.5 g |
| Potassium hydroxide | 1.0 g |
| Add water to make | 1 liter |
| [Bleaching liquid] | |
| Iron ammonium ethylene-diaminetetraacetate | 100.0 g |
| Diammonium ethylenediamninetetraacetate | 10.0 g |
| Ammonium bromide | 150.0 g |
| Glacial acetic acid | 10.0 ml |
| Add water to make | 1 liter |
| Adjust the pH value with aqueous ammonia to pH 6.0 | |
| [Fixing liquid] | |
| Ammonium thiosulfate | 175.0 g |
| Ammonium sulfite, anhydrated | 8.6 g |
| Sodium metasulfite | 2.3 g |
| Add water to make | 1 liter |
| Adjust the pH value with acetic acid to pH 6.0 | |
| [Stabilizing liquid] | |
| Formalin (a 37% aqueous solution) | 1.5 ml |
| Konidax (mfd. by Konishiroku Photo Ind. Co., Ltd., Japan.) | 7.5 ml |
| Add water to make | 1 liter |

With respect to the developed samples, the respective sensitometric characteristics, graininess and sharpness thereof were measured by making use of green-light.

Fogginess

A so-called minimum optical density on a characteristic curve, obtained from a sensitometry. (The higher a value of such a minimum optical density is, the more a fogginess is. Therefore, a high minimum optical density is not preferred.)

Sensitivity

The reciprocal of a quantity of exposure (in antilog) which gives an optical density of fog +0.1 on a characteristic curve. (In the table showing the results of the example, the reciprocal numbers each are expressed as a value relative to the sensitivity of the comparative example which is regarded as the value 100.: The higher a value of such a reciprocal number is, the higher a sensitivity is. Therefore, a high reciprocal number is preferred.)

Sharpness

The improvement effects on the sharpness of an image were detected by obtaining a MTF (which stands for Modulation Transfer Function) so as to compare the samples with each other with respect to the MTFs obtained when each spatial frequency is 10 lines per mm. The more a MTF value is, the more a sharpness is. That is preferred.

Graininess

The standard deviation of a density value variation is obtained when scanning a dye image having a ratio of a RMS to a dye image density of Dmin. +0.8 with a micro-densitometer having a round scanning aperture of 25μ, and 1,000 times this value is expressed as a value relative to the standard deviation value of a controlled sample regarded as a value of 100. The higher the value is, the more coarse a graininess is. That is not preferred.

Exposure range

The greater the difference between an exposure quantity (at a logarithmic value) giving an optical density with a fog of +0.1 and an exposure quantity (at a logarithmic value) giving a maximum optical density of −0.1 is, the wider an exposure range is. It is, therefore, preferred that a difference therebetween is greater.

Preparation of a multilayered color photographic material (hereinafter called an multilayered sample):

The silver iodobromide emulsions (EM-4 through EM-9) described in the above-mentioned preparation examples were chemically sensitized in an ordinary process so as to prepare a color photographic material comprising 9 layers including 3 kinds of light-sensitive layers, a blue light-sensitive layer, a green light-sensitive layer and a red light-sensitive layer, in the following manner. The emulsions EM-4 through EM-9 each chemically sensitized were changed only in a green-sensitive high speed layer that was the 5th layer. In each sample, the same and common emulsions were used in the other light-sensitive layers than the 5th layer.

The sample was prepared by coating the under-mentioned layers in order on a transparent support which comprises a sub-layered cellulose triacetate film and bears thereon an antihalation layer (containing 0.40 g of black colloidal silver and 3.0 g of gelatin). In all the examples mentioned below, an amount of every material to be added in light-sensitive materials is indicated by an amount per square meter, and both of a silver halide emulsion and a colloidal silver are indicated in terms of a silver content.

1st layer

A low speed red-sensitive emulsion layer (hereinafter called an RL layer) containing 1.4 g of a low speed red-sensitive silver iodobromide emulsion layer (containing silver iodide of 7 mol %) which was color-sensitized to red; 1.2 g of gelatin; 0.65 g of tricresyl phosphate (TCP) in which 0.8 g of 1-hydroxy-4-(β-methoxyethylaminocarbonylmethoxy)-N-[δ-(2,4-di-t-amylphenoxy)butyl]-2-naphthamide [hereinfter called C-1]; 0.075 g of 1-hydroxy-4-[4-(1-hydroxy-δ-acetamido-3,6-disulfo-2-naphthylazo)phenoxy]-N-[δ-(2,4-di-t-amylphenoxy)butyl-2-naphthamido.disodium [hereinafter called a colored cyan coupler (CC-1)]; and 0.015 g of 1-hydroxy-2[δ-2,4-di-t-amylphenoxy)n-butyl]naphthamide and 0.07 g of 4-octadecyl succinimido-2-(1-phenyl-5-tetrazolylthio)-1-indanone were dissolved {hereinafter called a DIR compound (D-1)} were dissolved.

2nd layer

A high speed red-sensitive emulsion layer (hereinafter called an RH layer) containing 1.3 g of a high speed red-sensitive silver iodobromide emulsion; 1.2 g of gelatin; and 0.23 g of TCP in which 0.21 g of cyan coupler (C-1); and 0.02 g of colored cyan coupler (CC-1) were dissolved.

3rd layer

An intermediate layer (hereinafter called an IL layer) containing 0.04 g of dibutyl phthalate (hereinafter called DBP) in which 0.07 g of 2,5-di-t-octylhydroquinone {hereinafter called an antistaining agent (HQ-1)} were dissolved; and 0.8 g of gelatin.

4th layer

A low speed green-sensitive emulsion layer (hereinafter called a GL layer) containing 0.80 g of a low speed silver iodobromide emulsion (containing silver iodide of 6 mol %) which was green-sensitized; 2.2 g of gelatin; 0.95 g of TCP in which 0.8 g of 1-(2,4,6-trichlorophenyl)3-[3-(2,4-di-t-amylphenoxyacetamido]-5-pyrazolone [hereinafter called a magenta coupler (M-1)]; 0.15 g of 1-(2,4,6-trichlophenyl)-4-(I-naphthylazo)-3-(2-chloro-5-octadecenylsuccineimidoanilino)-5-pyrazolone [herein after called a colored magenta coupler (CM-1)]; and 0.016 g of the DIR compound (D-1) were dissolved. 5th layer A high speed green-sensitive emulsion layer (hereinafter called a GH layer) containing 1.8 g of a high speed green-sensitive silver iodobromide emulsion which was green-sensitized; 1.9 g of gelatin; 0.25 g of TCP in which 0.20 g of the magenta coupler (M-1); and 0.049 g of the colored magenta coupler (CM-1) were dissolved.

6th layer

A yellow filter layer (hereinafter called a YC layer) containing 0.15 g of yellow colloidal silver; 0.11 g of DBP in which 0.2 g of the antistaining agent (HQ-1) was dissolved; and 1.5 g of gelatin.

7th layer

A low speed blue-sensitive emulsion layer (hereinafter called a BL layer) containing a low speed silver iodobromide emulsion (containing silver iodide of 4 mol %) which was blue-sensitized; 1.9 g of gelatin; and 0.6 g of TCP in which 1.5 g of α-pivaloyl-α-(1-benzyl-2-phenyl-3,5-dioxoimidazolidine-4-yl)-2'-chloro-5'-[α-dodecyloxycarbonyl)ethoxycarbonyl]acetanilide [hereinafter called Y-1] was dissolved.

8th layer

A high speed blue-sensitive emulsion layer (hereinafter called a BH layer) containing 1.0 g of a high speed silver iodobromide emulsion which was color-sensitized to blue; 1.5 g of gelatin; and 0.65 g of TCP in which 1.30 g of yellow coupler (Y-1) were dissolved.

9th layer

A protective layer (hereinafter called a PR layer) containing 2.3 g of gelatin.

Measurement of multilayer Sensitivity:

The prepared multilayered color photographic material was exposed to white light through a wedge and processed in the above-mentioned processing steps. A green optical sensitivity was obtained therefrom by a sensitometry. (The definition of sensitivity is the same as that in the case of the above-mentioned single layer coated sample.)

Results of Example 1 (The effects of the intermediate shell):

Table-14 shows the results of the fog, sensitivity, graininess, exposure range and sharpness of the single-color-sensitive coated sample as well as the results of the multilayered sample.

The core/shell type emulsions (EM-4 and EM-7) each provided with a highly iodide-containing shell, an intermediate shell and the outermost shell in accordance with the invention are capable of displaying an remarkably higher sensitivity, as compared with such a conventional core/shell type emulsion as EM-5 and EM-9 each not provided with any intermediate shell interposed between the outermost shell that is a low iodide-containing shell and a highly iodide-containing shell so as to contain iodide in an intermediate amount; such a core/shell type emulsion as EM-6 provided with an intermediate shell but having no reasonable difference in iodide contents between a highly iodide-containing shell and the intermediate shell; and such a core/shell type emulsion as EM-8 having no reasonable difference in iodide contents between the outermost shell and an intermediate shell.

It is also found that the above-mentioned effects are more remarkable in an multilayer sensitivity and that the core/shell type emulsions of the invention are more effective in a multi-layered color light-sensitive material.

The other core/shell type emulsions than those of the invention tend to broaden the grain size distribution and increase fogs, so that they may not be preferred to use, also from these points of view.

Example 2

Table-15 shows the effects of the iodide contents in highly iodide-containing shells resulted by making use of the emulsions EM-4, EM-5 and EM-9 through EM-18 of the above-mentioned Preparation Example and in the same manner as in Example 1.

The emulsions EM-10 through EM-15 are the examples in which the intermediate shells and the outermost shells each were made of the same while the iodide contents in the highly iodide-containing shells were varied. It is found therefrom that the higher the iodide content in a highly iodide-containing shell is, the higher the sensitivity is.

Such an emulsion having an iodide content of 40 or 50 mol % in the highly iodide-containing shell thereof as EM-15 or EM-17 tends to be less in sensitizing effect. This is supposedly due to the fact that the grain size distribution was broadened, and it is found that the emulsions of the invention may be able to enjoy a satisfactory sensitization effect as compared with any emulsions each having the same highly iodide-containing shell, such as EM-16 and EM-18, which are other than those of the invention.

Example 3

Table-16 shows, similarly to the above, the effects of the iodide contents in the low iodide-containing shells and the intermediate shells.

The lower the iodide content in the outermost shell is, the greater the sensitizing effects of the invention are.

Particularly in an multilayer sensitivity, the lower the iodide content in the outermost shell is, the greater the effects are. Such an emulsion as EM-26 having a high iodide content (by not less than 10 mol %) in the outermost shell thereof is rather lower in sensitivity than that of the comparative emulsions.

Example 4

Table-17 similarly shows the effects of the grain size distribution.

In the invention, the sensitizing effects may effectively be obtained than in a monodispersed emulsion having a narrow grain size distribution.

The emulsions each having a broader distribution are inferior, in sharpness, to the emulsions having a narrower distribution. The monodispersed emulsions of the invention are more preferred to serve as an emulsion excellent in sensitivity, fog and sharpness.

Example 5

Table-18 also shows the effects of the volume of a highly iodide-containing shell.

The sensitizing effects of the invention is rather less when the volume of a highly iodide-containing shell is little. say 5%, (as in EM-33), though the emulsion may be sensitized a little, and the effects may be enjoyed more when using an emulsion provided with a highly iodide-containing shell having such a relatively greater volume as 12% in EM-32, 22% in EM-33 and 41% in EM-34.

Example 6

Table-19 further shows the effects of an whole iodide content in the whole silver iodobromide.

In the invention, it is found that the emulsions each having a relatively higher whole iodide content, such as EM-35 and EM-36, are less in sensitizing effect; and that the emulsions each having a relatively lower whole iodide content, such as EM-38, are poor in graininess, sharpness and exposure range; and further that it is preferable to use the emulsions of the invention of which the iodide contents are within a suitable range, so that a high sensitivity, an excellent graininess, an excellent sharpness and a broad exposure range may be obtained.

TABLE 14

Example-1 (Effects of Intermediate shell)

| EM-No. | Ih mol % | Im mol % | Il mol % | ΔI = Ih − Il mol % | ΔIh = Ih − Im mol % | ΔIl = Im − Il mol % | Whole content of iodide % | Volume of each shell Vh % | Vm % | Vl % |
|---|---|---|---|---|---|---|---|---|---|---|
| EM-5 (Other than Invention) | 15 | 15 | 0.3 | 14.7 | 0 | 14.7 | 9.5 | 22 | 39 | 27 |
| EM-6 (Other than Invention) | 15 | 13 | 0.3 | 14.7 | 2 | 12.7 | 8.7 | 22 | 39 | 27 |
| EM-7 (Invention) | 15 | 10 | 0.3 | 14.7 | 5 | 9.7 | 7.5 | 22 | 39 | 27 |
| EM-4 (Invention) | 15 | 5 | 0.3 | 14.7 | 10 | 4.7 | 5.6 | 22 | 39 | 27 |
| EM-8 (Other than Invention) | 15 | 2 | 0.3 | 14.7 | 13 | 1.7 | 4.4 | 22 | 39 | 27 |
| EM-9 (Other than Invention) | 15 | 0.3 | 0.3 | 14.7 | 14.7 | 0 | 3.8 | 22 | 39 | 27 |

| EM-No. | Veriation coefficient % | Sensitivity | Fog | Graininess (R.M.S.) | Exposure range ΔlogE | Sharpness (MTF) % | Inter-layer sensitivity |
|---|---|---|---|---|---|---|---|
| EM-5 (Other than Invention) | 17 | 92 | 0.28 | 40 | 1.30 | 70 | 89 |
| EM-6 (Other than Invention) | 15 | 100 | 0.26 | 42 | 1.30 | 69 | 100 |
| EM-7 (Invention) | 12 | 163 | 0.24 | 38 | 1.30 | 75 | 178 |
| EM-4 (Invention) | 11 | 180 | 0.24 | 39 | 1.25 | 74 | 205 |
| EM-8 (Other than Invention) | 16 | 96 | 0.28 | 45 | 1.15 | 66 | 102 |
| EM-9 (Other than Invention) | 16 | 95 | 0.28 | 50 | 1.05 | 63 | 100 |

TABLE 15

Example-2 (Effects of iodide contents of highly iodide-containing shells)

| EM-No. | Ih mol % | Im mol % | Il mol % | ΔI = Ih − Il mol % | ΔIh = Ih − Im mol % | ΔIl = Im − Il mol % | Whole content of iodide % | Volume of each shell Vh % | Vm % | Vl % |
|---|---|---|---|---|---|---|---|---|---|---|
| EM-5 (Other than Invention) | 15 | 15 | 0.3 | 14.7 | 0 | 14.7 | 9.5 | 22 | 39 | 27 |
| EM-9 (Other than Invention) | 15 | 0.3 | 0.3 | 14.7 | 14.7 | 0 | 3.8 | 22 | 39 | 27 |
| EM-10 | 5 | 5 | 0.3 | 4.7 | 0 | 4.7 | 3.4 | 22 | 39 | 27 |

TABLE 15-continued

Example-2 (Effects of iodide contents of highly iodide-containing shells)

| | | | | | | | | | | |
|---|---|---|---|---|---|---|---|---|---|---|
| (Other than Invention) | | | | | | | | | | |
| EM-11 (Invention) | 8 | 5 | 0.3 | 7.7 | 3 | 4.7 | 4.1 | 22 | 39 | 27 |
| EM-12 (Invention) | 10 | 5 | 0.3 | 9.7 | 5 | 4.7 | 4.5 | 22 | 39 | 27 |
| EM-4 (Invention) | 15 | 5 | 0.3 | 14.7 | 10 | 4.7 | 5.6 | 22 | 39 | 27 |
| EM-13 (Invention) | 20 | 5 | 0.3 | 19.7 | 15 | 4.7 | 6.7 | 22 | 39 | 27 |
| EM-14 (Invention) | 30 | 5 | 0.3 | 29.7 | 25 | 4.7 | 8.8 | 22 | 39 | 27 |
| EM-15 (Invention) | 40 | 5 | 0.3 | 39.7 | 35 | 4.7 | 11.1 | 22 | 39 | 27 |
| EM-16 (Other than Invention) | 40 | 0.3 | 0.3 | 39.7 | 39.7 | 0 | 9.2 | 22 | 39 | 27 |
| EM-17 (Invention) | 50 | 5 | 0.3 | 49.7 | 45 | 4.7 | 12.2 | 22 | 39 | 27 |
| EM-18 (Other than Invention) | 50 | 0.3 | 0.3 | 49.7 | 49.7 | 0 | 11.4 | 22 | 39 | 27 |

| EM-No. | Veriation coefficient % | Sensitivity | Fog | Graininess (R.M.S.) | Exposure range ΔlogE | Sharpness (MTF) % | Inter-layer sensitivity |
|---|---|---|---|---|---|---|---|
| EM-5 (Other than Invention) | 17 | 92 | 0.28 | 40 | 1.30 | 70 | 89 |
| EM-9 (Other than Invention) | 16 | 95 | 0.28 | 50 | 1.05 | 63 | 100 |
| EM-10 (Other than Invention) | 10 | 90 | 0.24 | 52 | 1.98 | 66 | 92 |
| EM-11 (Invention) | 10 | 117 | 0.24 | 45 | 1.10 | 72 | 115 |
| EM-12 (Invention) | 11 | 165 | 0.24 | 47 | 1.16 | 69 | 175 |
| EM-4 (Invention) | 11 | 180 | 0.24 | 39 | 1.25 | 74 | 205 |
| EM-13 (Invention) | 12 | 170 | 0.24 | 40 | 1.30 | 75 | 180 |
| EM-14 (Invention) | 13 | 160 | 0.26 | 38 | 1.32 | 78 | 175 |
| EM-15 (Invention) | 18 | 145 | 0.28 | 36 | 1.33 | 70 | 165 |
| EM-16 (Other than Invention) | 19 | 95 | 0.30 | 41 | 1.26 | 68 | 98 |
| EM-17 (Invention) | 35 | 110 | 0.35 | 46 | 1.28 | 66 | 112 |
| EM-18 (Other than Invention) | 39 | 87 | 0.34 | 45 | 1.30 | 65 | 90 |

TABLE 16

Example-3 (Effects of iodide contents of low iodide-containing shells and intermediate shells)

| EM-No. | Ih mol % | Im mol % | Il mol % | ΔI = Ih − Il mol % | ΔIh = Ih − Im mol % | ΔIl = Im − Il mol % | Whole content of iodide % | Volume of each shell Vh % | Vm % | Vl % |
|---|---|---|---|---|---|---|---|---|---|---|
| EM-5 (Other than Invention) | 15 | 15 | 0.3 | 14.7 | 0 | 14.7 | 9.5 | 22 | 39 | 27 |
| EM-9 (Other than Invention) | 15 | 0.3 | 0.3 | 14.7 | 14.7 | 0 | 3.8 | 22 | 39 | 27 |
| EM-19 (Invention) | 15 | 5 | 0 | 15 | 10 | 5 | 5.5 | 22 | 39 | 27 |
| EM-4 (Invention) | 15 | 5 | 0.3 | 14.7 | 10 | 4.7 | 5.6 | 22 | 39 | 27 |
| EM-20 (Invention) | 15 | 5 | 0.5 | 14.5 | 10 | 4.5 | 5.7 | 22 | 39 | 27 |
| EM-21 (Invention) | 15 | 5 | 1.5 | 13.5 | 10 | 3.5 | 5.9 | 22 | 39 | 27 |
| EM-22 (Other than Invention) | 15 | 5 | 4.5 | 10.5 | 10 | 0.5 | 6.7 | 22 | 39 | 27 |

TABLE 16-continued

| Example-3 (Effects of iodide contents of low iodide-containing shells and intermediate shells) | | | | | | | | | | |
|---|---|---|---|---|---|---|---|---|---|---|
| EM-7 (Invention) | 15 | 10 | 0.3 | 14.7 | 5 | 9.7 | 7.5 | 22 | 39 | 27 |
| EM-6 (Other than Invention) | 15 | 13 | 0.3 | 14.7 | 2 | 12.7 | 8.7 | 22 | 39 | 27 |
| EM-23 (Invention) | 15 | 10 | 1.5 | 13.5 | 5 | 8,5 | 7.9 | 22 | 39 | 27 |
| EM-24 (Invention) | 15 | 10 | 4.5 | 10.5 | 5 | 5.5 | 8.7 | 22 | 39 | 27 |
| EM-25 (Other than Invention) | 15 | 10 | 8 | 7 | 5 | 2 | 9.6 | 22 | 39 | 27 |
| EM-26 (Other than Invention) | 25 | 17 | 11 | 14 | 8 | 6 | 15.3 | 22 | 39 | 27 |

| EM-No. | Veriation coefficient % | Sensitivity | Fog | Graininess (R.M.S.) | Exposure range ΔlogE | Sharpness (MTF) % | Inter-layer sensitivity |
|---|---|---|---|---|---|---|---|
| EM-5 (Other than Invention) | 17 | 92 | 0.28 | 40 | 1.30 | 70 | 89 |
| EM-9 (Other than Invention) | 16 | 95 | 0.28 | 50 | 1.05 | 63 | 100 |
| EM-19 (Invention) | 10 | 175 | 0.24 | 38 | 1.32 | 73 | 190 |
| EM-4 (Invention) | 11 | 180 | 0.24 | 39 | 1.25 | 74 | 205 |
| EM-20 (Invention) | 11 | 181 | 0.24 | 41 | 1.28 | 75 | 210 |
| EM-21 (Invention) | 11 | 130 | 0.24 | 38 | 1.30 | 77 | 114 |
| EM-22 (Other than Invention) | 11 | 95 | 0.24 | 47 | 1.30 | 78 | 55 |
| EM-7 (Invention) | 12 | 163 | 0.24 | 38 | 1.30 | 75 | 198 |
| EM-6 (Other than Invention) | 15 | 100 | 0.26 | 42 | 1.30 | 69 | 100 |
| EM-23 (Invention) | 12 | 155 | 0.24 | 40 | 1.28 | 74 | 145 |
| EM-24 (Invention) | 12 | 120 | 0.24 | 45 | 1.30 | 75 | 118 |
| EM-25 (Other than Invention) | 12 | 68 | 0.24 | 49 | 1.32 | 75 | 38 |
| EM-26 (Other than Invention) | 13 | 65 | 0.26 | 51 | 1.31 | 78 | 40 |

TABLE 17

| Example-4 (Effects of grain size distribution) | | | | | | | | | | |
|---|---|---|---|---|---|---|---|---|---|---|
| EM-No. | Ih mol % | Im mol % | Il mol % | ΔI = Ih − Il mol % | ΔIh = Ih − Im mol % | ΔIl = Im − Il mol % | Whole content of iodide % | Volume of each shell Vh % | Vm % | Vl % |
| EM-5 (Other than Invention) | 15 | 15 | 0.3 | 14.7 | 0 | 14.7 | 9.5 | 22 | 39 | 27 |
| EM-9 (Other than Invention) | 15 | 0.3 | 0.3 | 14.7 | 14.7 | 0 | 3.8 | 22 | 39 | 27 |
| EM-4 (Invention) | 15 | 5 | 0.3 | 14.7 | 10 | 4.7 | 5.6 | 22 | 39 | 27 |
| EM-27 (Invention) | 15 | 5 | 0.3 | 14.7 | 10 | 4.7 | 5.6 | 22 | 39 | 27 |
| EM-28 (Invention) | 15 | 5 | 0.3 | 14.7 | 10 | 4.7 | 5.6 | 22 | 39 | 27 |
| EM-29 (Other than Invention) | 15 | 0.3 | 0.3 | 14.7 | 14.7 | 0 | 3.8 | 22 | 39 | 27 |
| EM-30 (Invention) | 15 | 5 | 0.3 | 14.7 | 10 | 4.7 | 5.6 | 22 | 39 | 27 |
| EM-31 (Other than Invention) | 15 | 0.3 | 0.3 | 14.7 | 14.7 | 0 | 3.8 | 22 | 39 | 27 |
| EM-15 | 15 | 5 | 0.3 | 39.7 | 35 | 4.7 | 11.1 | 22 | 39 | 27 |

TABLE 17-continued

Example-4 (Effects of grain size distribution)

| | | | | | | | | | | |
|---|---|---|---|---|---|---|---|---|---|---|
| (Invention) EM-17 (Invention) | 50 | 5 | 0.3 | 49.7 | 45 | 4.7 | 12.2 | 22 | 39 | 27 |

| EM-No. | Veriation coefficient % | Sensitivity | Fog | Graininess (R.M.S.) | Exposure range ΔlogE | Sharpness (MTF) % | Inter-layer sensitivity |
|---|---|---|---|---|---|---|---|
| EM-5 (Other than Invention) | 17 | 92 | 0.28 | 40 | 1.30 | 70 | 89 |
| EM-9 (Other than Invention) | 16 | 95 | 0.28 | 50 | 1.05 | 63 | 100 |
| EM-4 (Invention) | 11 | 180 | 0.24 | 39 | 1.25 | 74 | 205 |
| EM-27 (Invention) | 9 | 190 | 0.22 | 38 | 1.28 | 75 | 210 |
| EM-28 (Invention) | 18 | 180 | 0.28 | 36 | 1.32 | 68 | 195 |
| EM-29 (Other than Invention) | 19 | 101 | 0.30 | 55 | 0.95 | 63 | 98 |
| EM-30 (Invention) | 32 | 152 | 0.42 | 42 | 1.30 | 66 | 164 |
| EM-31 (Other than Invention) | 34 | 116 | 0.38 | 48 | 1.01 | 60 | 95 |
| EM-15 (Invention) | 18 | 145 | 0.28 | 36 | 1.33 | 70 | 165 |
| EM-17 (Invention) | 35 | 110 | 0.35 | 46 | 1.28 | 66 | 112 |

TABLE 18

Example-5 (Effects of volume of highly iodide-containing shells)

| EM-No. | Ih mol % | Im mol % | Il mol % | ΔI = Ih − Il mol % | ΔIh = Ih − Im mol % | ΔIl = Im − Il mol % | Whole content of iodide % | Volume of each shell Vh % | Vm % | Vl % |
|---|---|---|---|---|---|---|---|---|---|---|
| EM-5 (Other than Invention | 15 | 15 | 0.3 | 14.7 | 0 | 14.7 | 9.5 | 22 | 39 | 27 |
| EM-9 (Other than Invention | 15 | 0.3 | 0.3 | 14.7 | 14.7 | 0 | 3.8 | 22 | 39 | 27 |
| EM-4 (Invention) | 15 | 5 | 0.3 | 14.7 | 10 | 4.7 | 5.6 | 22 | 39 | 27 |
| EM-32 (Invention) | 15 | 5 | 0.3 | 14.7 | 10 | 4.7 | 4.6 | 12 | 49 | 27 |
| EM-33 (Invention) | 15 | 5 | 0.3 | 14.7 | 10 | 4.7 | 4.0 | 5 | 56 | 27 |
| EM-34 (Invention) | 15 | 5 | 0.3 | 14.7 | 10 | 4.7 | 7.6 | 41 | 20 | 27 |

| EM-No. | Veriation coefficient % | Sensitivity | Fog | Graininess (R.M.S.) | Exposure range ΔlogE | Sharpness (MTF) % | Inter-layer sensitivity |
|---|---|---|---|---|---|---|---|
| EM-5 (Other than Invention | 17 | 92 | 0.28 | 40 | 1.30 | 70 | 89 |
| EM-9 (Other than Invention | 16 | 95 | 0.28 | 50 | 1.05 | 63 | 100 |
| EM-4 (Invention) | 11 | 180 | 0.24 | 39 | 1.25 | 74 | 205 |
| EM-32 (Invention) | 10 | 165 | 0.24 | 45 | 1.10 | 70 | 185 |
| EM-33 (Invention) | 10 | 115 | 0.24 | 44 | 1.08 | 68 | 138 |
| EM-34 (Invention) | 12 | 152 | 0.24 | 33 | 1.35 | 76 | 164 |

TABLE 19

Example-6 (Effects of an aggregate iodide content)

| | Ih | Im | Il | ΔI = Ih − Il | ΔIh = Ih − Im | ΔIl = Im − Il | Whole content of | Volume of each shell |
|---|---|---|---|---|---|---|---|---|

TABLE 19-continued

Example-6 (Effects of an aggregate iodide content)

| EM-No. | mol % | mol % | mol % | mol % | mol % | mol % | iodide % | Vh % | Vm % | Vl % |
|---|---|---|---|---|---|---|---|---|---|---|
| EM-5 (Other than Invention) | 15 | 15 | 0.3 | 14.7 | 0 | 14.7 | 9.5 | 22 | 39 | 27 |
| EM-9 (Other than Invention) | 15 | 0.3 | 0.3 | 14.7 | 14.7 | 0 | 3.8 | 22 | 39 | 27 |
| EM-4 (Invention) | 15 | 5 | 0.3 | 14.7 | 10 | 4.7 | 5.6 | 22 | 39 | 27 |
| EM-35 (Invention) | 25 | 10 | 5 | 20 | 15 | 5 | 11 | 22 | 39 | 27 |
| EM-36 (Invention) | 35 | 10 | 5 | 30 | 25 | 5 | 13.7 | 22 | 39 | 27 |
| EM-37 (Other than Invention) | 35 | 7.5 | 5 | 30 | 27.5 | 2.5 | 12.2 | 22 | 39 | 27 |
| EM-33 (Invention) | 15 | 5 | 0.3 | 14.7 | 10 | 4.7 | 4.0 | 5 | 56 | 27 |
| EM-38 (Invention) | 8 | 4 | 0.3 | 7.7 | 4 | 3.7 | 1.6 | 5 | 56 | 27 |
| EM-39 (Other than Invention) | 8 | 0.3 | 0.3 | 7.7 | 0 | 1.0 | 5 | 56 | 27 | |

| EM-No. | Veriation coefficient % | Sensitivity | Fog | Graininess (R.M.S.) | Exposure range ΔlogE | Sharpness (MTF) % | Inter-layer sensitivity |
|---|---|---|---|---|---|---|---|
| EM-5 (Other than Invention) | 17 | 92 | 0.28 | 40 | 1.32 | 70 | 89 |
| EM-9 (Other than Invention) | 16 | 95 | 0.28 | 50 | 1.05 | 63 | 100 |
| EM-4 (Invention) | 11 | 180 | 0.24 | 39 | 1.25 | 74 | 205 |
| EM-35 (Invention) | 12 | 132 | 0.24 | 55 | 1.32 | 75 | 115 |
| EM-36 (Invention) | 14 | 116 | 0.26 | 60 | 1.28 | 70 | 107 |
| EM-37 (Other than Invention) | 13 | 70 | 0.26 | 65 | 1.32 | 70 | 35 |
| EM-33 (Invention) | 10 | 130 | 0.24 | 45 | 1.10 | 68 | 155 |
| EM-38 (Invention) | 9 | 105 | 0.22 | 63 | 0.90 | 63 | 105 |
| EM-39 (Other than Invention) | 11 | 80 | 0.24 | 70 | 0.95 | 62 | 75 |

What is claimed is:

1. A negative type silver halide photographic material comprising silver halide grains of a core-shell structure comprising:

(1) an inner core consisting essentially of silver bromide or silver iodobromide, the silver iodide content of said inner core being within the range of 0 to 40 mole %, and (2) a plurality of shells consisting essentially of silver bromide or silver iodobromide, the shells of each silver halide grain comprising:

(a) an outermost shell containing 0 to 10 mole % silver iodide, (b) a highly iodide-containing shell provided inside said outermost shell and having a silver iodide content within the range of 8 to 40 mole % and at least 8 mole % higher than that of said outermost shell, and (c) an intermediate shell provided between the outermost shell and the highly iodide-containing shell, the silver iodide content of said intermediate shell being at least 3 mole % higher than that of said outermost shell, and at least 3 mole % lower than that of said highly iodide-containing shell, the whole content of silver iodide in each silver halide grain being within the range of 2 to less than 12 mole %.

2. The silver halide photographic material of claim 1, wherein the silver iodide content of said highly iodide containing-shell is within the range of 10 to 40 mol %.

3. The silver halide photographic material of claim 1, wherein the silver iodide content of said outermost shell is within the range of 0 to 3 mol %.

4. The silver halide photographic material of claim 3, wherein the silver iodide content of said outermost shell is within the range of 0 to 2 mol %.

5. The silver halide photographic material of claim 4, wherein the silver iodide content of said outermost shell is within the range of 0 to 1 mol %.

6. The silver halide photographic material of claim 1, wherein the difference the silver iodide content of between said intermediate shell and said outermost shell is within the range of 4 to 35 mol %.

7. The silver halide photographic material of claim 1, wherein the difference between the silver iodide content of said highly iodide-containing shell and said intermediate shell is within the range of 4 to 35 mol %.

8. The silver halide photographic material of claim 1, wherein the difference between the silver iodide content between said highly iodide-containing shell and said outermost shell is not less than 10 mol %.

9. The silver halide photographic material of claim 1, wherein silver iodide content of said inner core is within the range of 0 to 10 mol %.

10. The silver halide photographic material of claim 9, wherein silver iodide content of said inner core is within the range of 0 to 6 mol %.

11. The silver halide photographic material of claim 1, wherein the volume of said outermost shell is within the range of 4 to 70% of the whole volume of said silver halide grain.

12. The silver halide photographic material of claim 11, wherein the volume of said outermost shell is within the range of 10 to 50% of the whole volume of said silver halide grain.

13. The silver halide photographic material of claim 1, wherein the volume of said highly iodide-containing shell is within the range of 10 to 80% of the whole volume of said silver halide grain.

14. The silver halide photographic material of claim 13, wherein the volume of said highly iodide-containing shell is within the range of 20 to 50% of the whole volume of said silver halide grain.

15. The silver halide photographic material of claim 14, wherein the volume of said highly iodide-containing shell is within the range of 20 to 45% of the whole volume of said silver halide grain.

16. The silver halide photographic material of claim 1, wherein the volume of said intermediate shell is within the range of 5 to 60% of the whole volume of said silver halide grain.

17. The silver halide photographic material of claim 16, wherein the volume of said intermediate shell is within the range of 20 to 55% of the whole volume of said silver halide grain.

18. The silver halide photographic material of claim 1, wherein the size of said inner core is within the range of 0.05 to 0.8 μm.

19. The silver halide photographic material of claim 18, wherein the size of said inner core is within the range of 0.05 to 0.4 μm.

20. The silver halide photographic material of claim 1, wherein said silver halide grains are in a monodispersed state.

21. The silver halide photographic material of claim 20, wherein a variation coefficient representing the monodispersed state of said silver halide grains is not more than 20%.

22. The silver halide photographic material of claim 21, wherein said variation coefficient is not more than 15%.

* * * * *